US009789712B2

(12) United States Patent
Tanaka

(10) Patent No.: US 9,789,712 B2
(45) Date of Patent: Oct. 17, 2017

(54) TAPE CARTRIDGE AND PRINTER

(71) Applicant: Brother Kogyo Kabushiki Kaisha, Nagoya-shi, Aichi-ken (JP)

(72) Inventor: Mitsugi Tanaka, Nogoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/056,185

(22) Filed: Feb. 29, 2016

(65) Prior Publication Data

US 2016/0176210 A1 Jun. 23, 2016

Related U.S. Application Data

(63) Continuation of application No. PCT/JP2014/075616, filed on Sep. 26, 2014.

(30) Foreign Application Priority Data

Oct. 31, 2013 (JP) ..... 2013-226614

(51) Int. Cl.
*B41J 15/04* (2006.01)
*B41J 3/407* (2006.01)

(52) U.S. Cl.
CPC ..... *B41J 15/044* (2013.01); *B41J 3/4075* (2013.01)

(58) Field of Classification Search
CPC . B41J 11/02; B41J 11/04; B41J 11/053; B41J 11/057; B41J 11/06; B41J 11/08; B41J 11/10; B41J 11/13; B41J 3/46; B41J 2/325; B41J 29/38; B41J 3/4075; B41J 15/044
See application file for complete search history.

(56) References Cited

U.S. PATENT DOCUMENTS

| | | | |
|---|---|---|---|
| 5,078,523 | A | 1/1992 | McGourty et al. |
| 5,318,370 | A | 6/1994 | Nehowig |
| 5,455,617 | A | 10/1995 | Stephenson et al. |
| 6,076,982 | A | 6/2000 | Katsuno |
| 6,132,119 | A | 10/2000 | Nakajima et al. |
| 6,520,696 | B2 | 2/2003 | Huss et al. |
| 8,297,738 | B1 | 10/2012 | Kodama et al. |
| 8,297,739 | B1 | 10/2012 | Kodama et al. |

(Continued)

FOREIGN PATENT DOCUMENTS

| | | | |
|---|---|---|---|
| CN | 102950913 | A | 3/2013 |
| CN | 103253011 | A | 8/2013 |

(Continued)

OTHER PUBLICATIONS

May 12, 2016—(WO) IPRP—App PCT/JP2014/075616.
Feb. 4, 2014—(CN) Notification of First Office Action—App 201480053698.1.
Dec. 22, 2014—International Search Report—Intl App PCT/JP2014/075616.
May 12, 2017—(EP) Extended Search Report—App 14857907.1.
Jul. 20, 2017—(JP) Notification of Reasons for Refusal—App 2013-226614.

*Primary Examiner* — Kristal Feggins
(74) *Attorney, Agent, or Firm* — Banner & Witcoff, Ltd.

(57) ABSTRACT

The disclosure discloses a tape cartridge including a first tape roll, a first support member, a storage medium, and a terminal part. The first tape roll has a first core that includes an outer circumferential side around which a tape is wound capable of being fed out. The first support member rotatably supports the first core of the first tape roll. The storage medium is disposed on the first support member and is capable of reading or writing of information. The terminal part is disposed on the first support member while being exposed outside and is conductive with the storage medium.

12 Claims, 15 Drawing Sheets

(56) References Cited

U.S. PATENT DOCUMENTS

| | | | |
|---|---|---|---|
| 8,439,482 | B1 | 5/2013 | Kodama et al. |
| 8,920,054 | B2 | 12/2014 | Yokoyama |
| 2002/0012558 | A1 | 1/2002 | Huss et al. |
| 2003/0184642 | A1 | 10/2003 | Shibata et al. |
| 2013/0182046 | A1 | 7/2013 | Kodama et al. |
| 2013/0182047 | A1 | 7/2013 | Nozawa et al. |
| 2013/0182048 | A1 | 7/2013 | Nozawa et al. |
| 2013/0182049 | A1 | 7/2013 | Kodama et al. |
| 2013/0182052 | A1 | 7/2013 | Matsuzaki et al. |
| 2013/0182053 | A1 | 7/2013 | Kodama et al. |
| 2013/0216292 | A1 | 8/2013 | Yokoyama |
| 2014/0152746 | A1 | 6/2014 | Kodama et al. |
| 2014/0210917 | A1 | 7/2014 | Kodama et al. |
| 2014/0368585 | A1 | 12/2014 | Nozawa et al. |
| 2015/0077486 | A1 | 3/2015 | Kodama et al. |
| 2016/0129696 | A1 | 5/2016 | Nozawa et al. |
| 2016/0375688 | A1 | 12/2016 | Kodama et al. |

FOREIGN PATENT DOCUMENTS

| | | | |
|---|---|---|---|
| CN | 103370203 | A | 10/2013 |
| EP | 0654760 | A2 | 5/1995 |
| JP | H09-097461 | A | 4/1997 |
| JP | H11-010979 | A | 1/1999 |
| JP | 2001-171905 | A | 6/2001 |
| JP | 2003-285494 | A | 10/2003 |
| JP | 2006-043835 | A | 2/2006 |
| JP | H07-031391 | U | 2/2006 |
| JP | 2006-264337 | A | 10/2006 |
| JP | 2006-347136 | A | 12/2006 |
| JP | 4552558 | B2 | 9/2010 |
| WO | 94/11196 | A1 | 5/1994 |

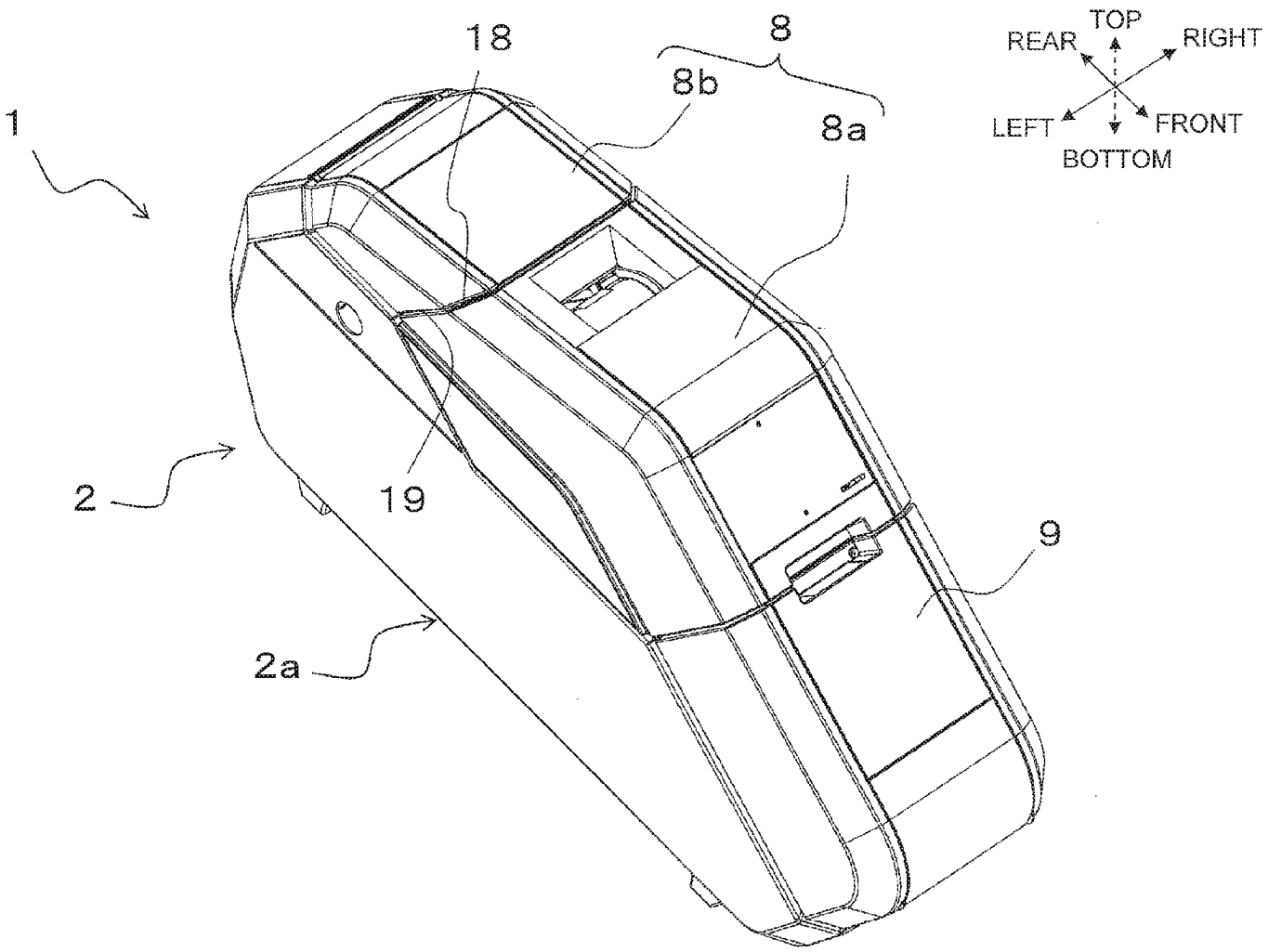
[FIG. 1]

[FIG. 2]
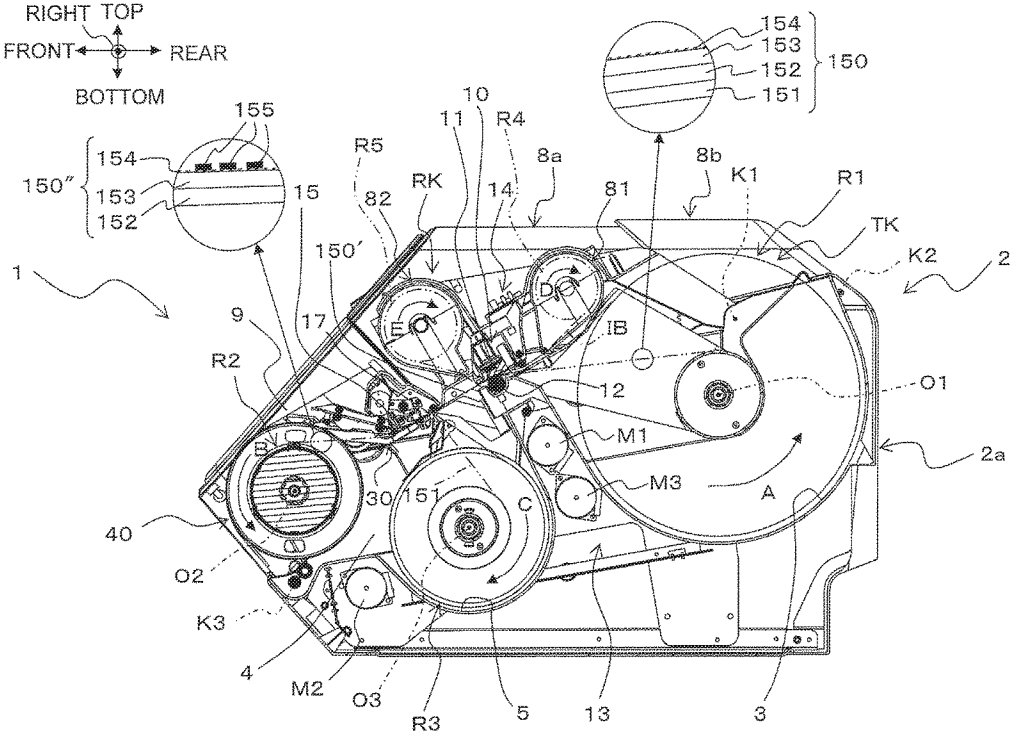

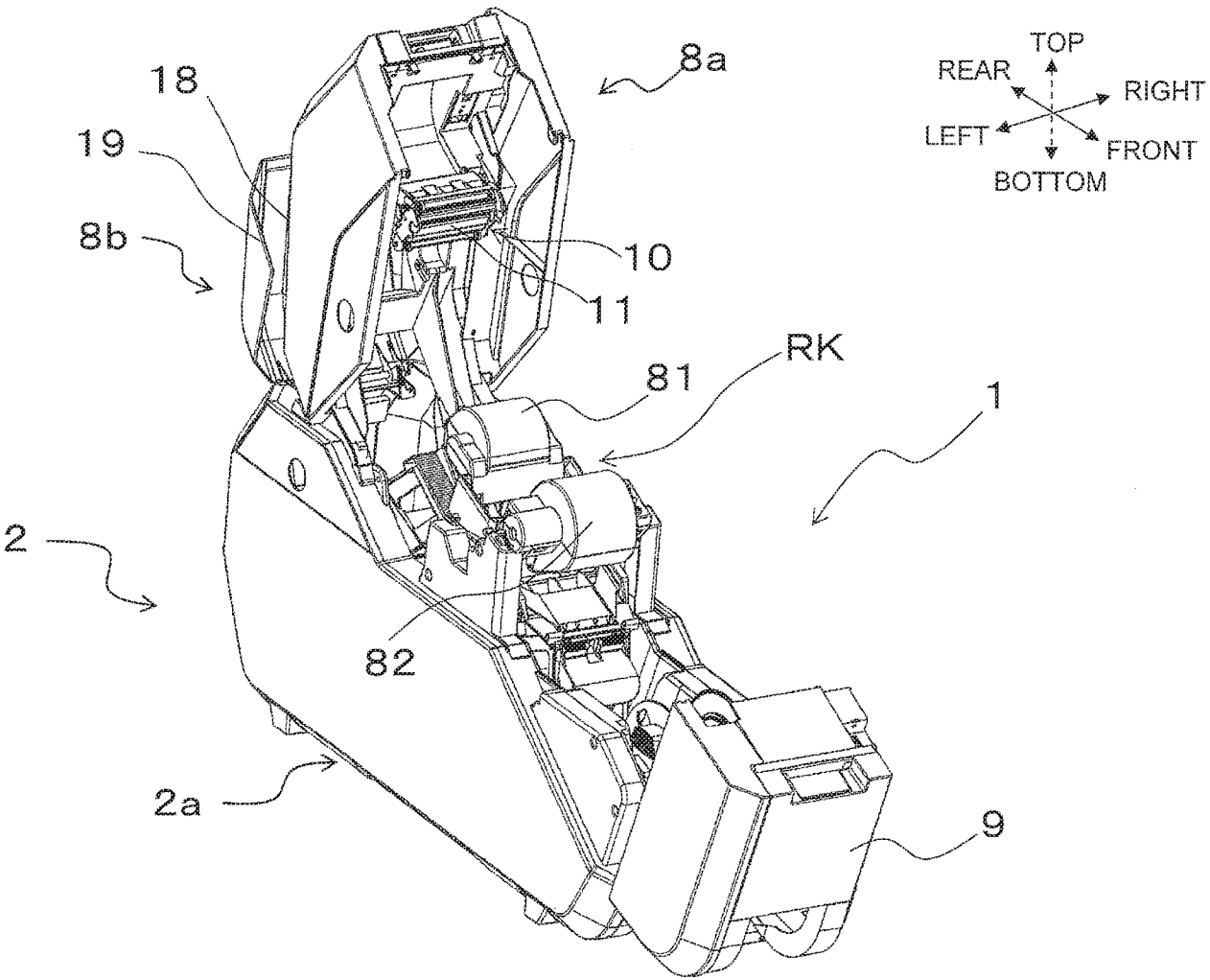
[FIG. 3]

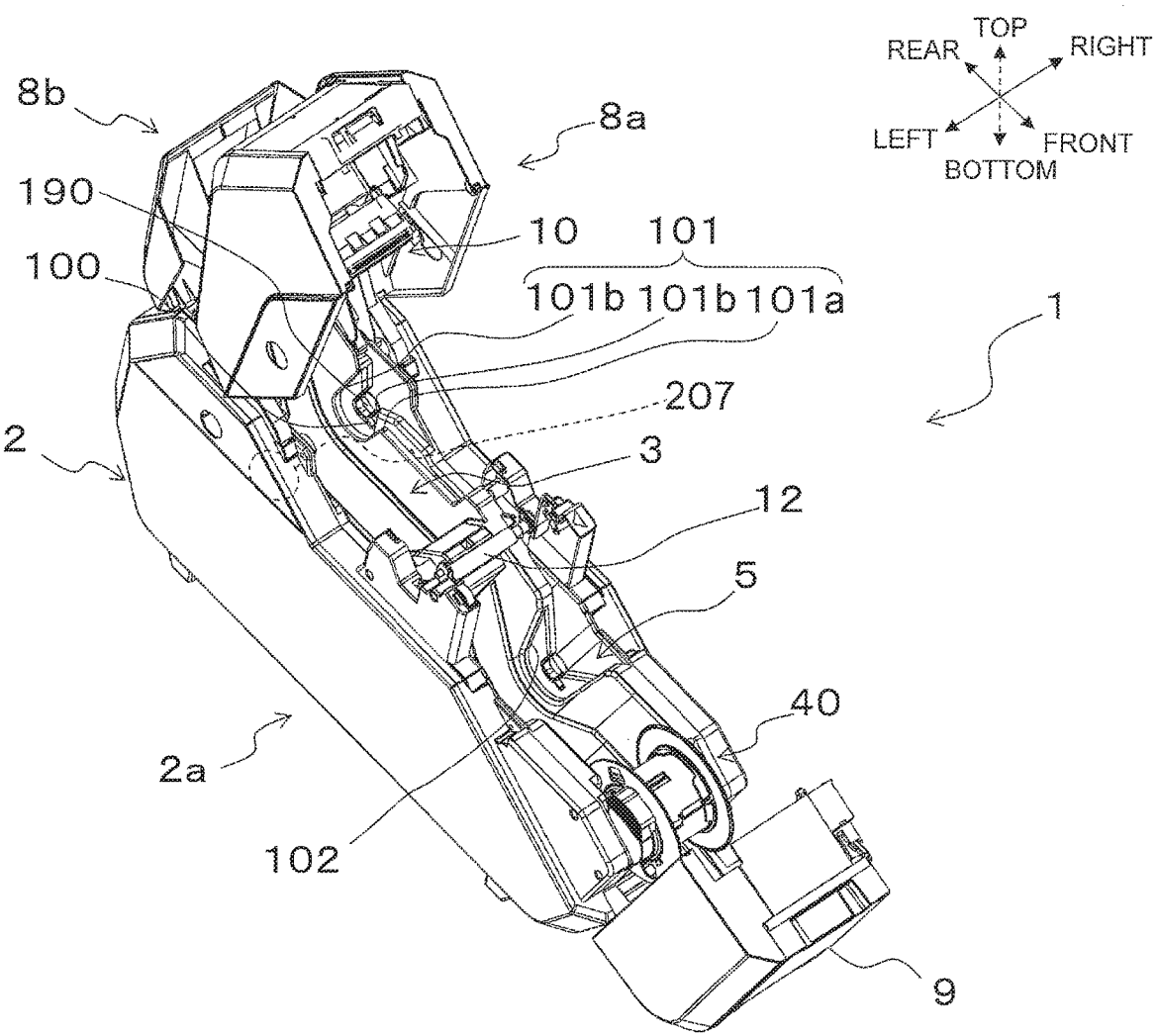
[FIG. 4]

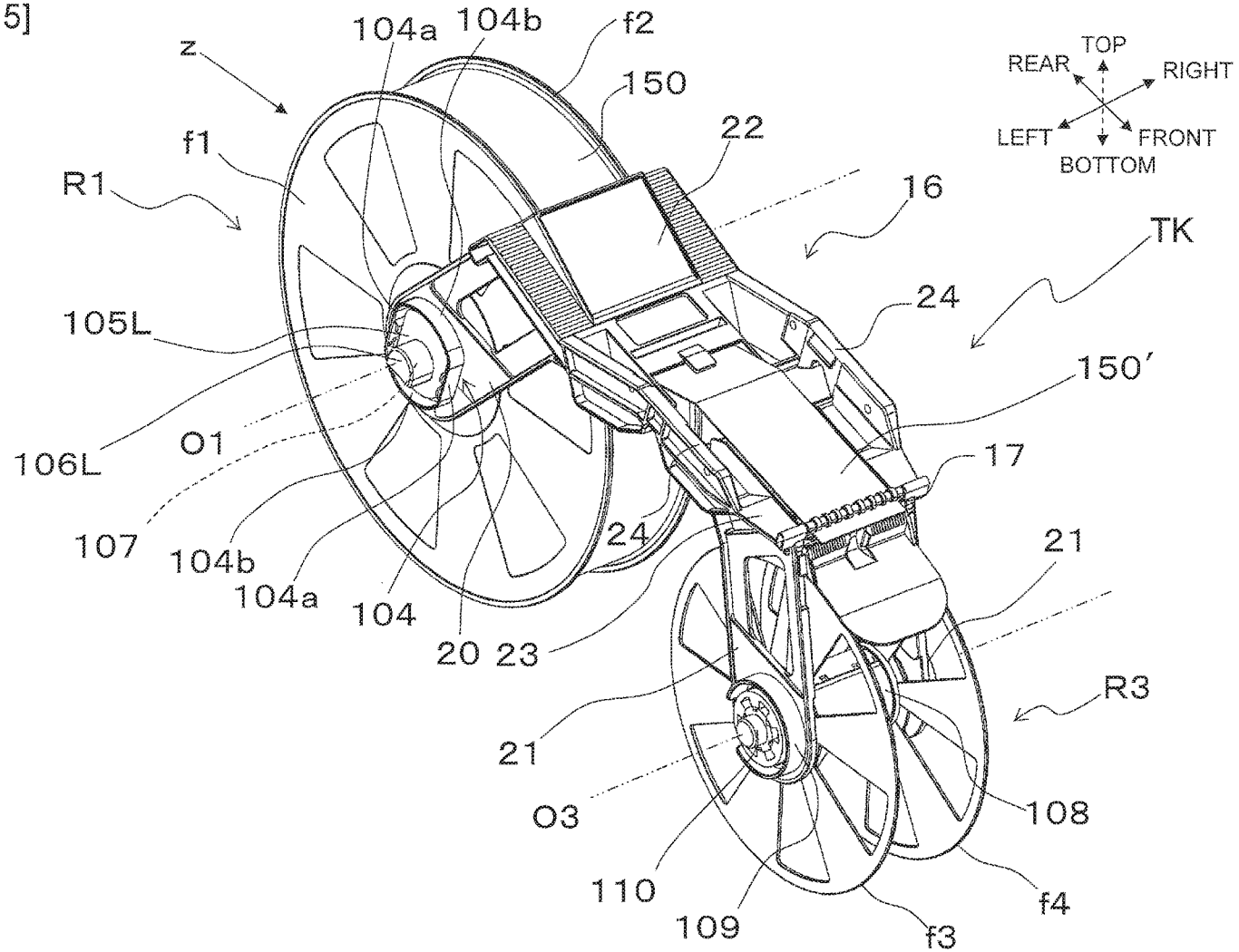
[FIG. 5]

[FIG. 6]
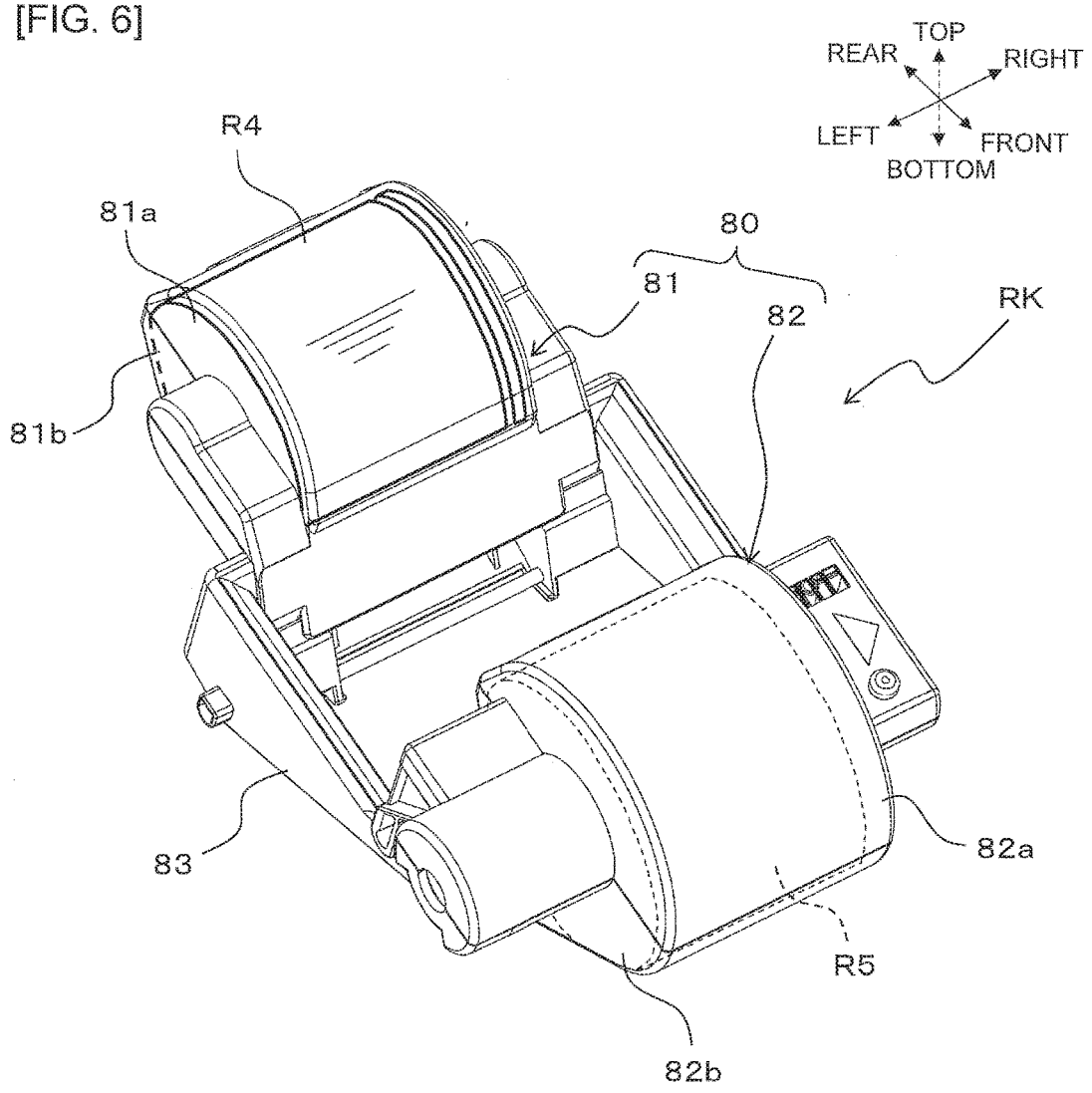

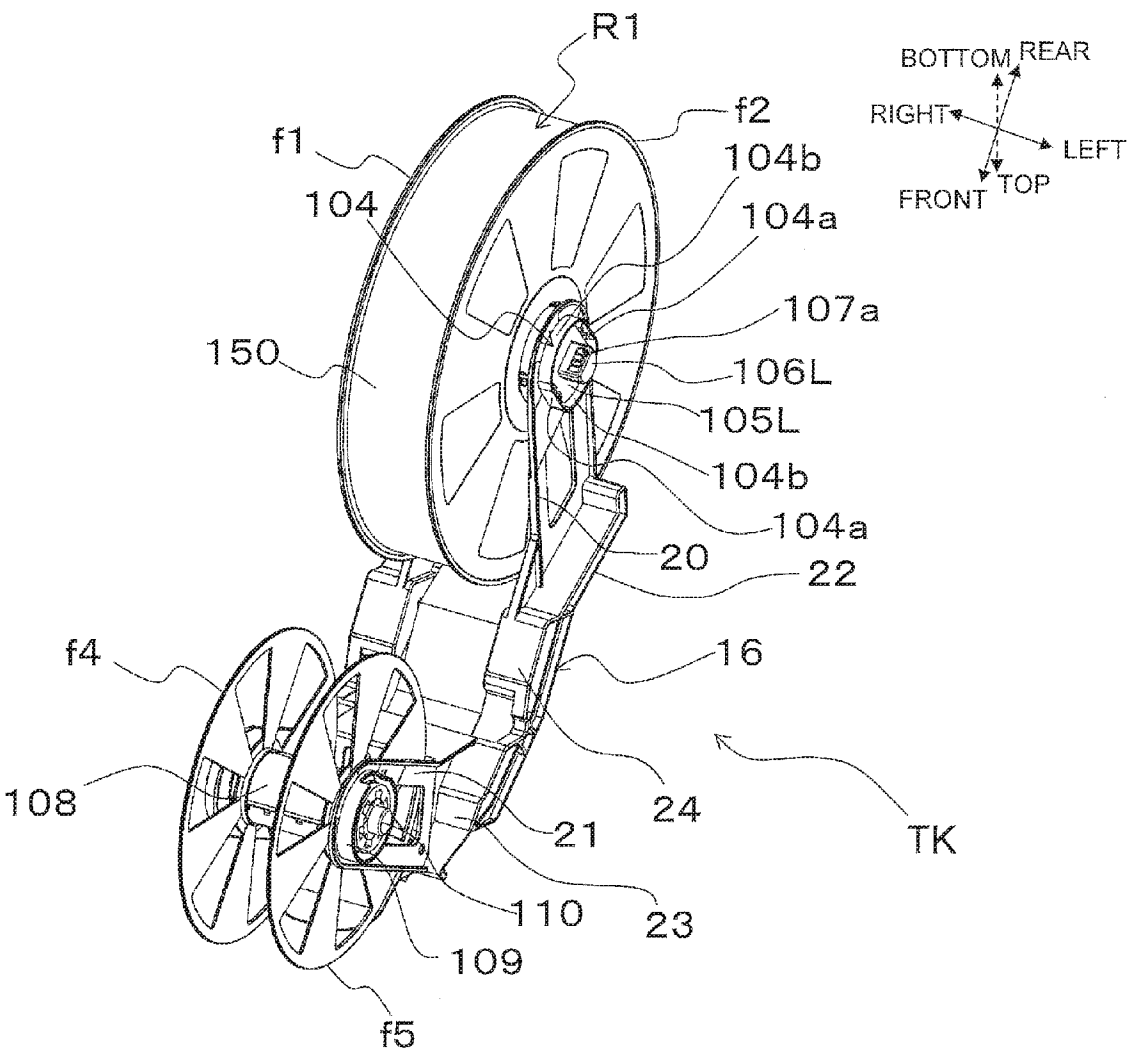
[FIG. 7]

[FIG. 8]
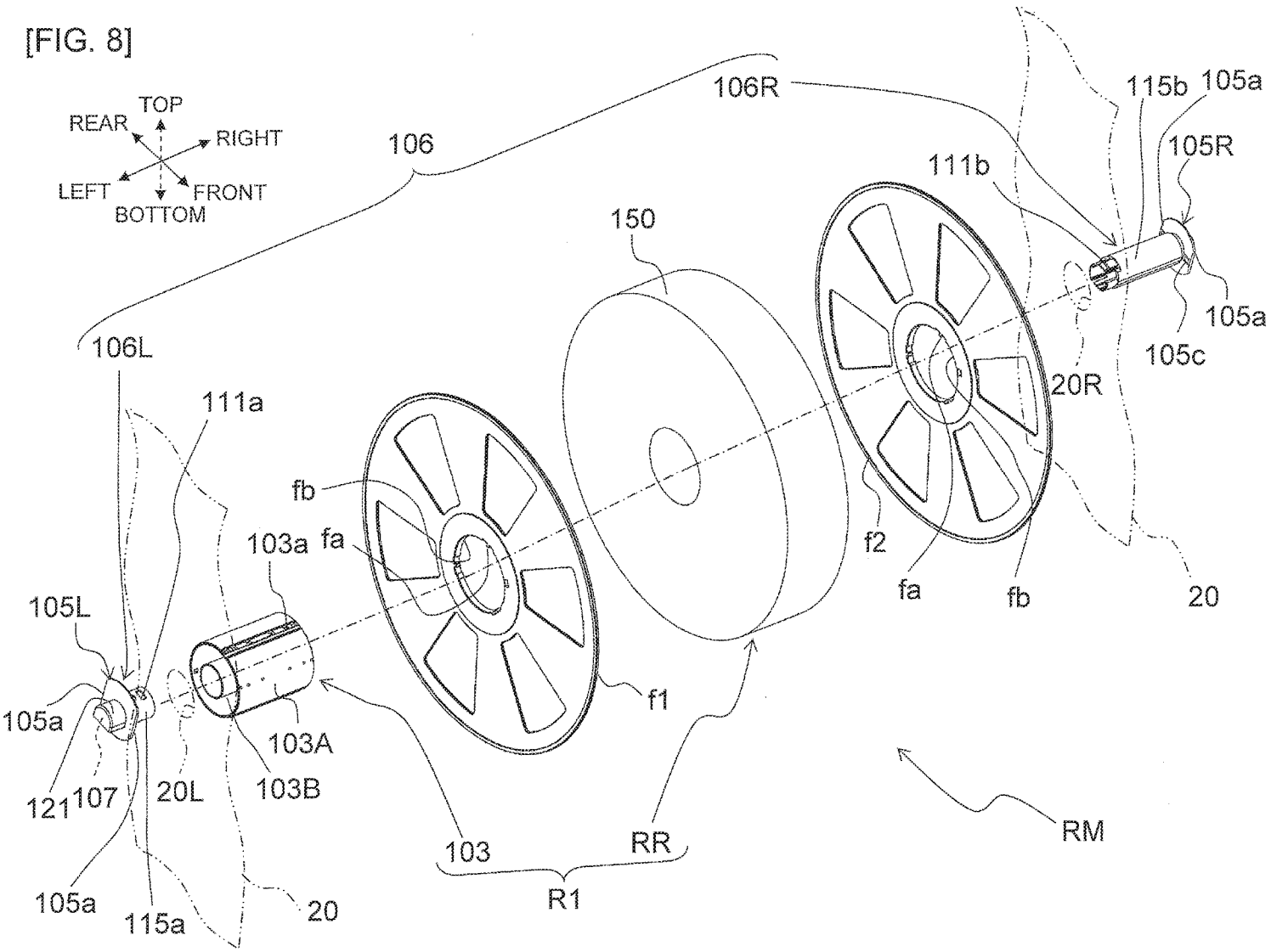

[FIG. 9A]
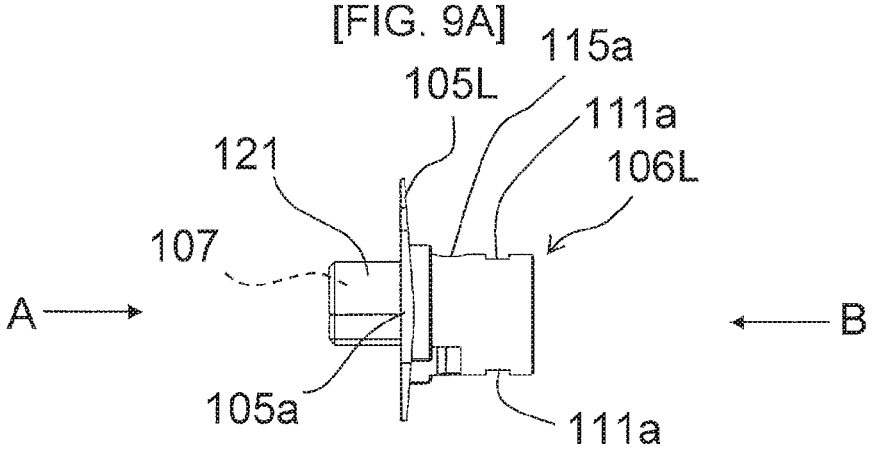
[FIG. 9B]
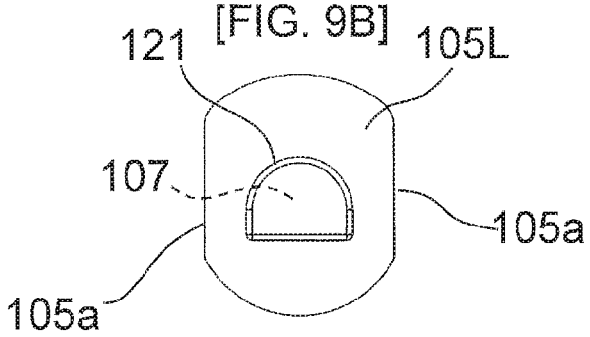
[FIG. 9C]
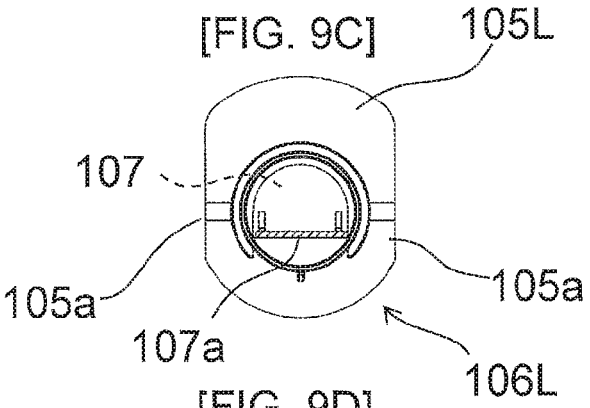
[FIG. 9D]
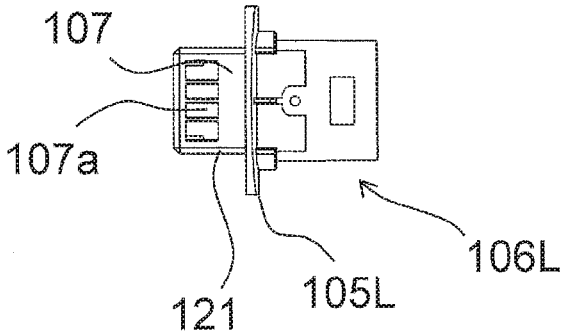

[FIG. 10]
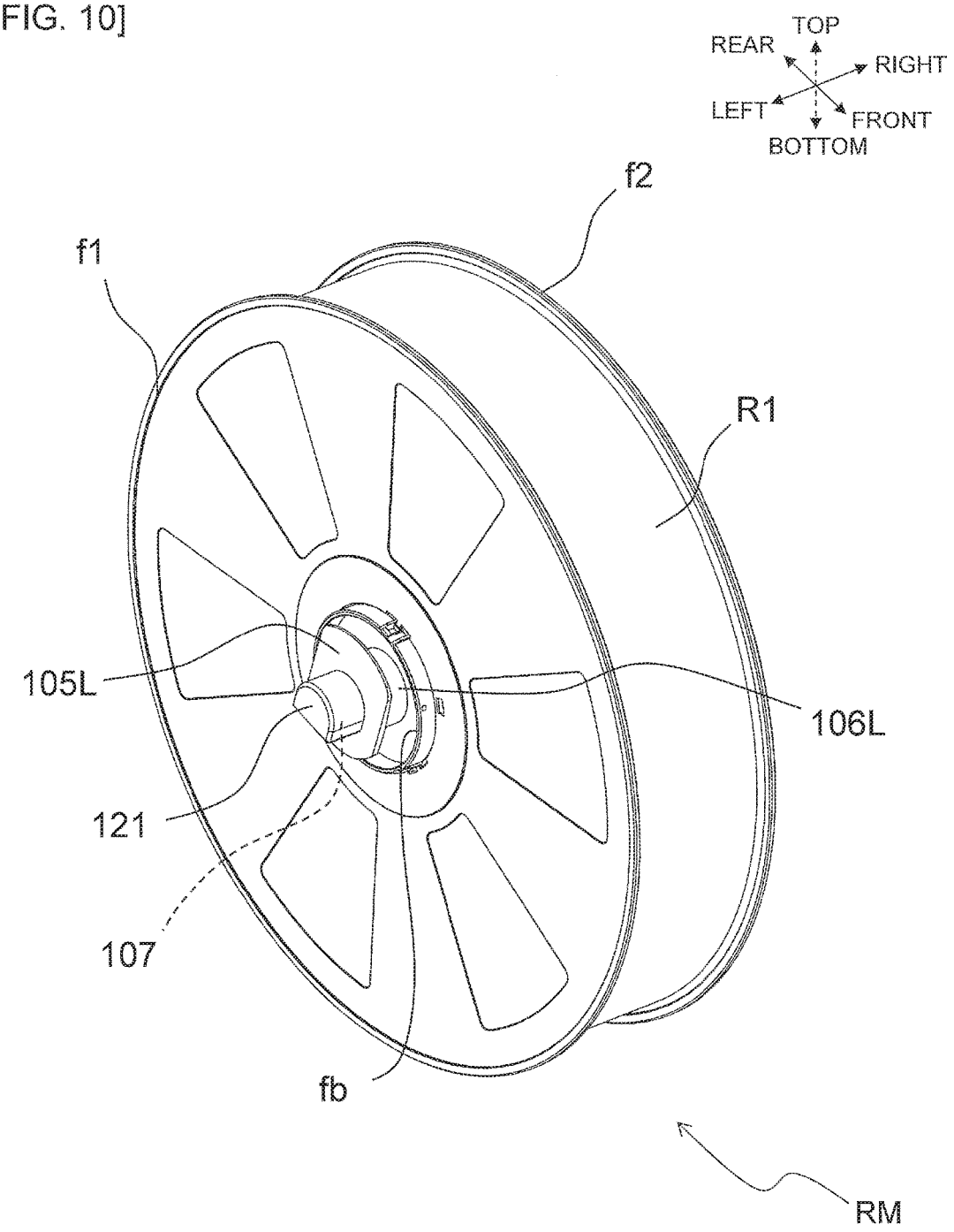

[FIG. 11]
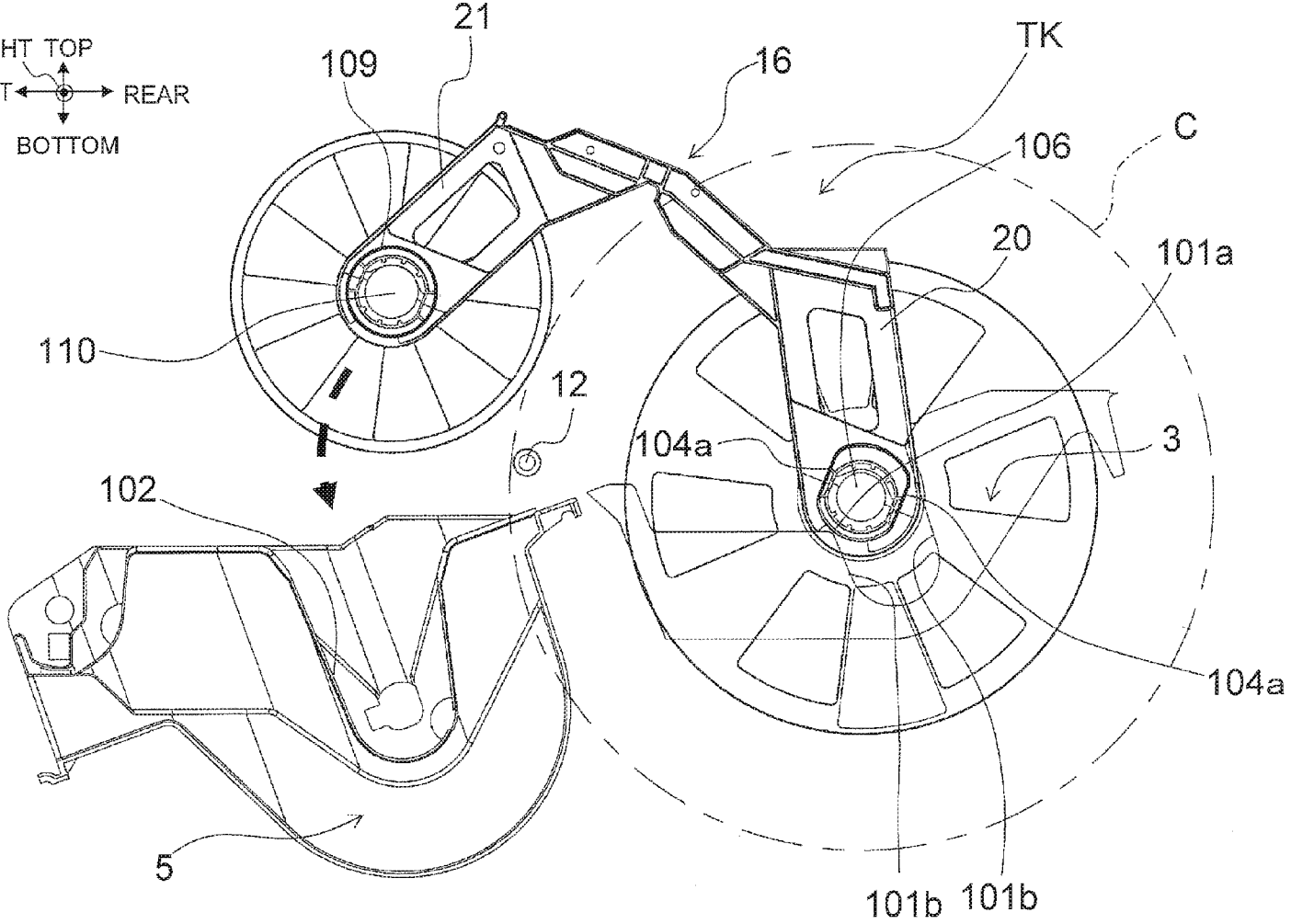

[FIG. 12]
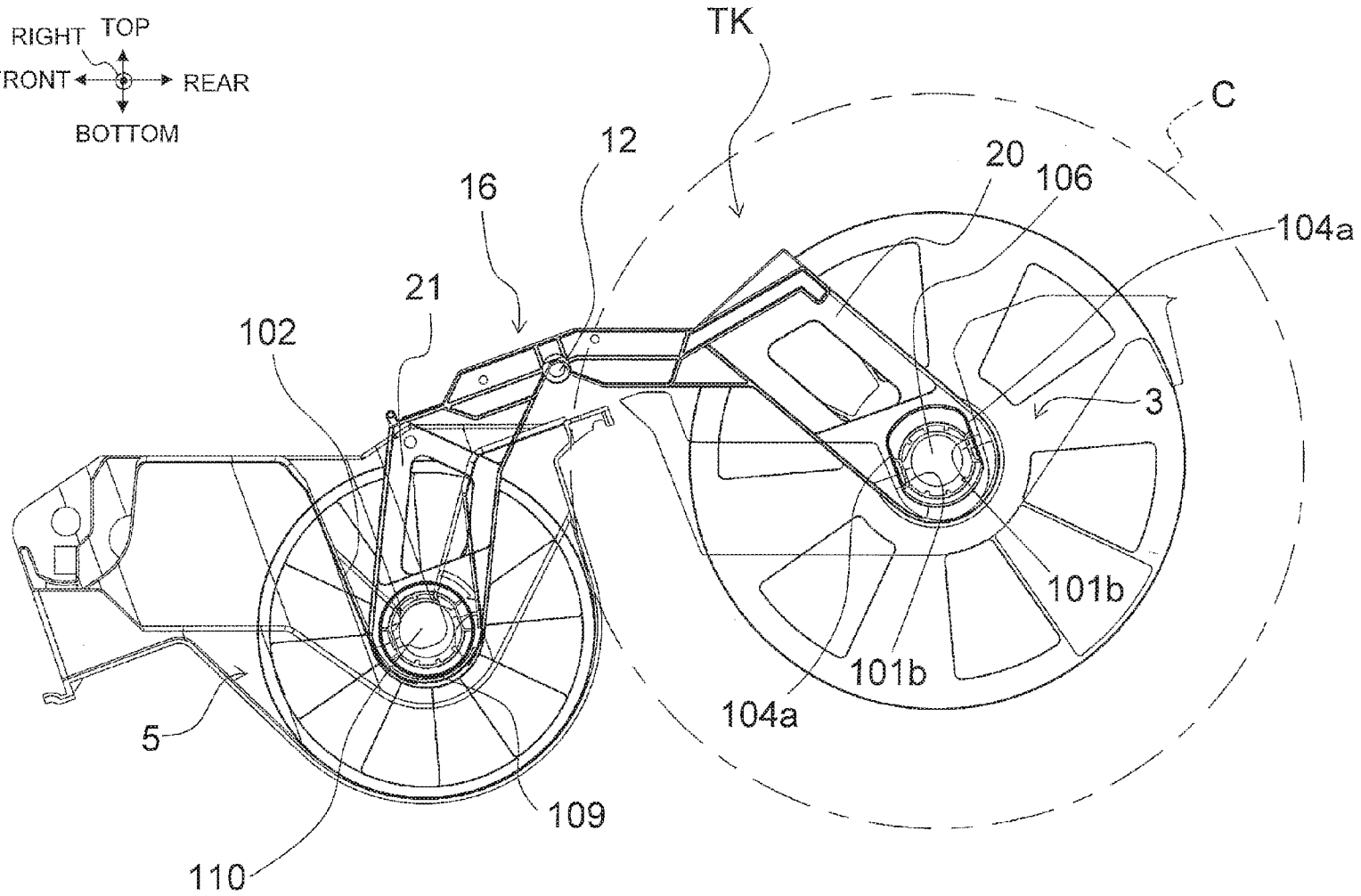

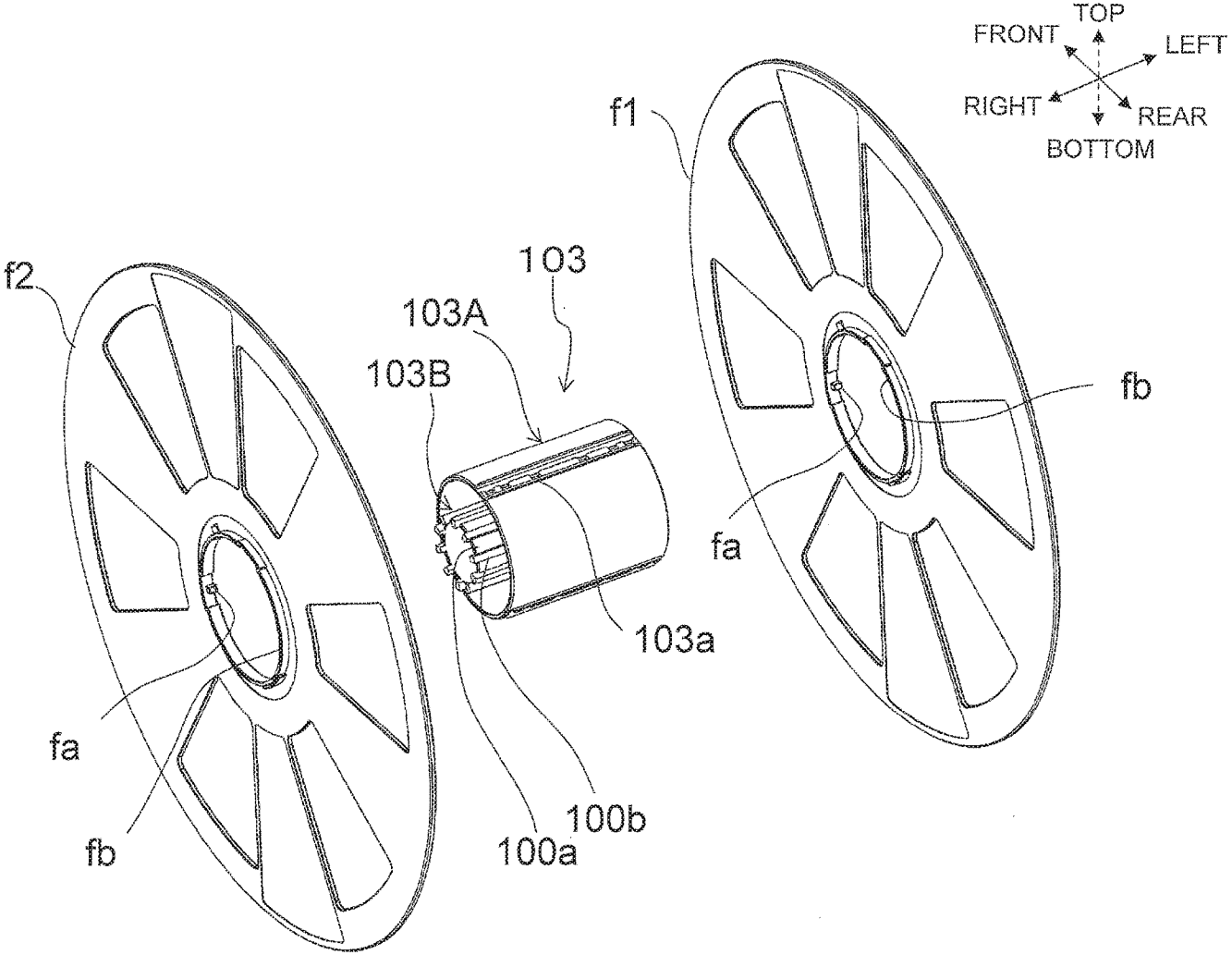
[FIG. 13]

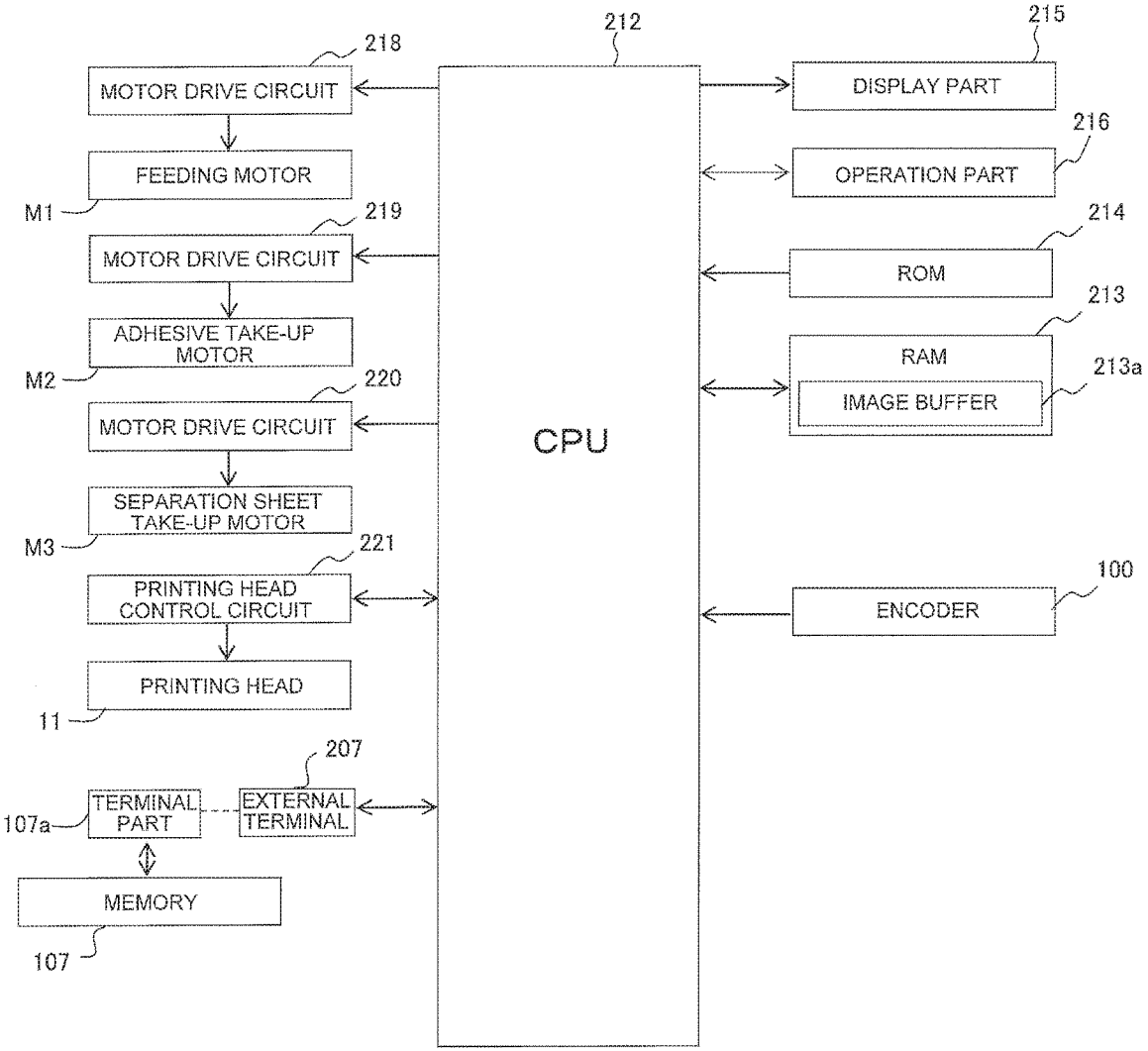
[FIG. 14]

[FIG. 15B]
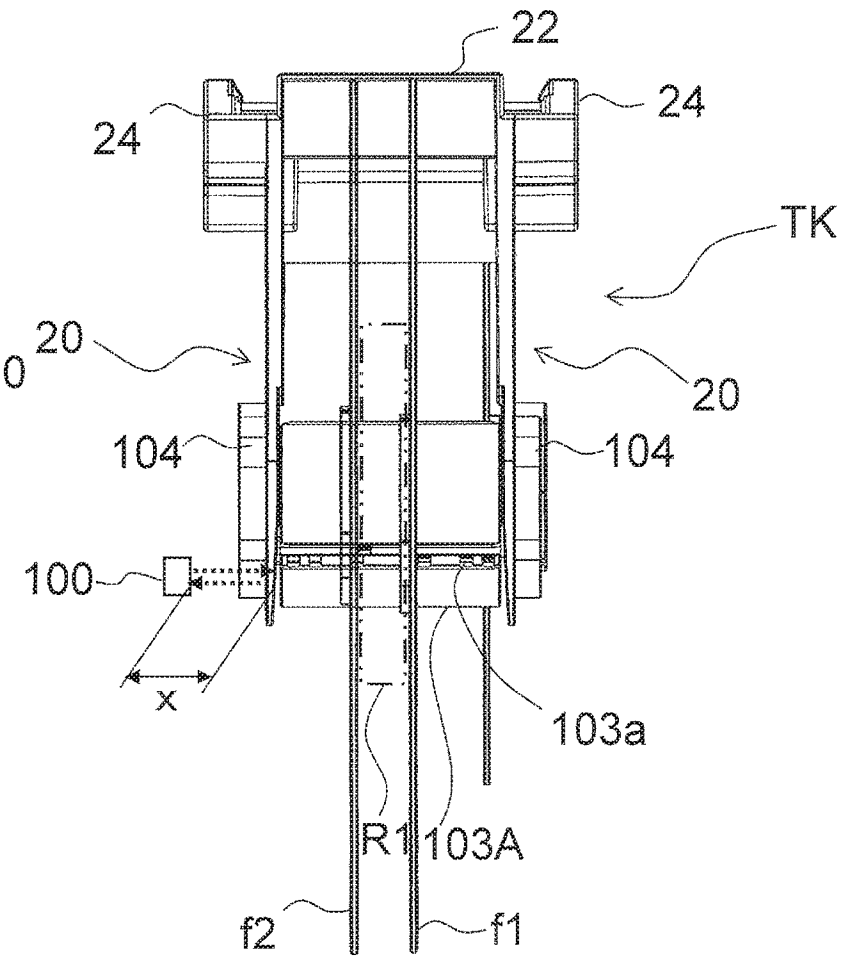
[FIG. 15A]
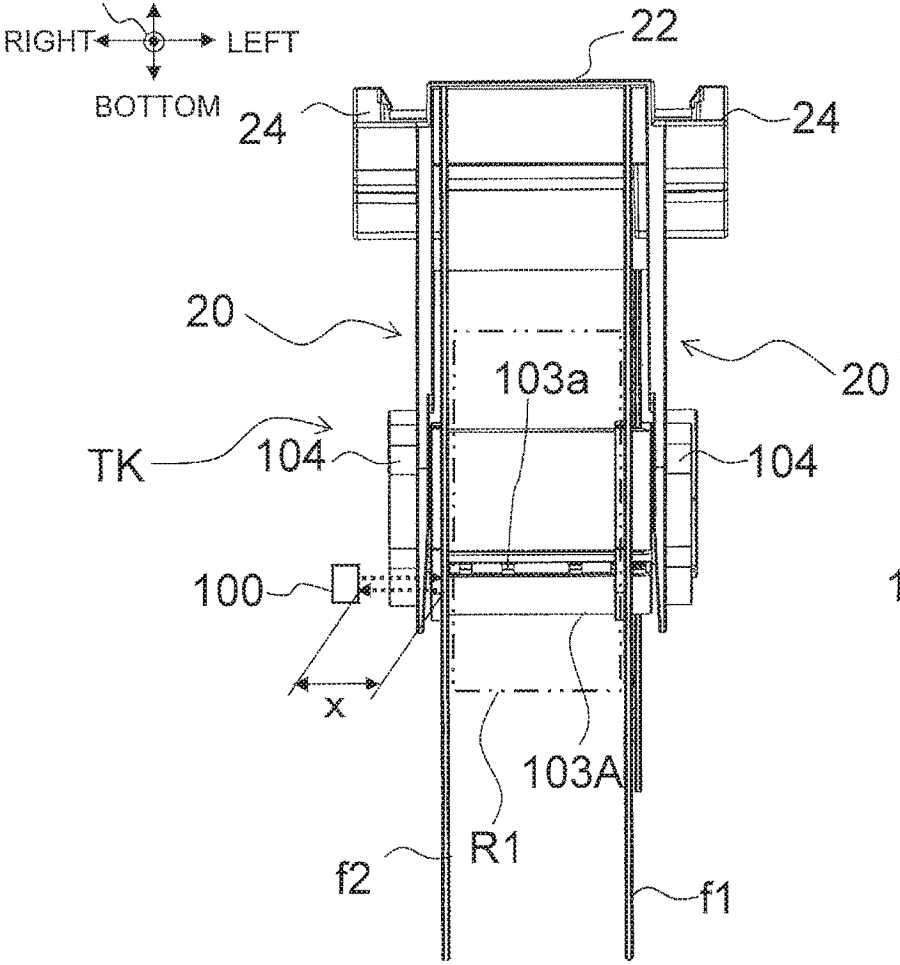

TAPE CARTRIDGE AND PRINTER

CROSS-REFERENCE TO RELATED APPLICATION

This is a continuation application of PCT/JP2014/075616, filed Sep. 26, 2014, which was not published under PCT article 21(2) in English.

BACKGROUND

Field

The present disclosure relates to a tape cartridge including a support member rotatably supporting a core of a tape roll, and a printer using the tape cartridge for printing.

Description of the Related Art

A technique is already known in which 6 an information recording part is disposed on an end part of a tape roll attachable to and detachable from a printer to read and write information such as a used tape amount of the tape roll from and to the information recording part.

The prior art is a non-versatile special information transfer technique including writing information with markers or inkjet printing of invisible ink and reading the printed information with infrared radiation. Therefore, to enhance versatility and easily electronically write (or read) comparatively large capacity information, it is conceivable that a storage medium is disposed on a roll. In this case, a terminal part conductive to the storage medium is disposed on and exposed outside the roll and, when the roll is mounted on the printer, an external terminal disposed on the printer can be brought into contact and made conductive with the terminal part so that predetermined information can be read from or written to the storage medium.

However, the external terminal and the terminal part may not necessarily reliably be brought into contact with each other when the roll is mounted on the printer depending on the disposed positions of the storage medium and the terminal part, which makes it difficult to read or write information with high reliability.

SUMMARY

It is an object of the present disclosure to provide a tape cartridge and a printer capable of reading or writing the information from or to a storage medium with high reliability.

In order to achieve the above-described object, according to an aspect of the present disclosure, there is provided a tape cartridge comprising a first tape roll having a first core that includes an outer circumferential side around which a tape is wound capable of being fed out, a first support member that is configured to rotatably support the first core of the first tape roll, a storage medium that is disposed on the first support member and is capable of reading or writing of information, and a terminal part that is disposed on the first support member while being exposed outside and is conductive with the storage medium.

The tape cartridge of the present disclosure has the first tape roll and the first support member. The first tape roll is formed by winding the tape around the outer circumferential side of the first core. The first support member rotatably supports the first core of the first tape roll. When the tape cartridge is used, the first support member is mounted and used on the predetermined mounting position.

In the present disclosure, the storage medium is disposed on the first support member, and the terminal part conductive with this storage medium is disposed and exposed to the outside. As a result, for example, an external terminal etc. disposed outside the tape cartridge can be brought into contact and made conductive with the terminal part so as to read or write desired information from or to the storage medium via the terminal part.

Since the first support member is mounted and used on the predetermined mounting position when the tape cartridge of the present disclosure is used, the weight of the first tape roll acting as a rotating body is applied to the first support member. The storage medium and the terminal part are disposed on the first support member. As a result, as compared to when the storage medium and the terminal part are disposed on other positions to which the weight is less applied, the external terminal and the terminal part can stably and reliably be brought into contact with each other. As a result, the information can be read from or written to the storage medium with high reliability.

BRIEF DESCRIPTION OF DRAWINGS

FIG. 1 is a perspective view of an exterior appearance of a tape printer related to an embodiment of the present disclosure.

FIG. 2 is a side cross-sectional view of an internal structure of the tape printer.

FIG. 3 is a perspective view of the exterior appearance of the tape printer with a first openable cover, a second openable cover, and a front openable cover opened.

FIG. 4 is a perspective view of the tape printer with the first openable cover, the second openable cover, and the front openable cover opened and with a tape cartridge and an ink ribbon cartridge removed.

FIG. 5 is a perspective view of an overall configuration of the tape cartridge.

FIG. 6 is a perspective view of an overall configuration of the ink ribbon cartridge from above.

FIG. 7 is a perspective view of the overall configuration of the tape cartridge from below.

FIG. 8 is an exploded perspective view of constituent elements of a roll mechanism with a shaft incorporated in the tape cartridge.

FIG. 9A is a side view of a detailed structure of a left fixed shaft part.

FIG. 9B is an arrow view in a direction A of FIG. 9A.

FIG. 9C is an arrow view in a direction B of FIG. 9A.

FIG. 9D is a bottom view a detailed structure of the left fixed shaft part.

FIG. 10 is a perspective view of a modification example of the roll mechanism with a shaft.

FIG. 11 is a partially transparent explanatory view of an entry limiting state of the tape cartridge.

FIG. 12 is a partially transparent explanatory view of an entry permitting state of the tape cartridge.

FIG. 13 is an exploded perspective view of main parts making up a print-receiving tape roll, showing an identifier to be detected disposed on a core.

FIG. 14 is a functional block diagram of a configuration of a control system of the tape printer.

FIG. 15A is an arrow view of the tape cartridge in a direction Z of FIG. 5.

FIG. 15B is an arrow view of the tape cartridge in the direction Z of FIG. 5.

DETAILED DESCRIPTION OF THE PREFERRED EMBODIMENTS

An embodiment of the present disclosure will now be described with reference to the drawings. If "front," "rear,"

"left," "right," "top," and "bottom" are noted in the drawings, "front (forward)," "rear (backward)," "left (leftward)," "right (rightward)," "top (above, upper)," and "bottom (under, lower)" in the description indicate the noted directions.

<General Configuration of Tape Printer>

A general configuration of a tape printer of this embodiment will be described with reference to FIGS. 1 to 4.

<Housing>

In FIGS. 1 to 4, a tape printer 1 of this embodiment has a housing 2 making up an outer contour of the apparatus. The housing 2 includes a housing main body 2*a*, a rear openable part 8, and a front openable cover 9.

The housing main body 2*a* includes therein a first storage part 3 disposed on the rear side as well as a second storage part 5 and a third storage part 4 disposed on the front side.

The rear openable part 8 is connected to an upper part on the rear side of the housing main body 2*a* in an openable manner. The rear openable part 8 can rotate to open and close the top of the first storage part 3. The rear openable part 8 is made up of a first openable cover 8*a* and a second openable cover 8*b*.

The first openable cover 8*a* can rotate around a predetermined rotation axis K1 disposed on an upper part on the rear side of the housing main body 2*a* to open and close the top on the front side of the first storage part 3. Specifically, the first openable cover 8*a* can rotate from a closing position covering the top on the front side of the first storage part 3 (a state of FIG. 1, FIG. 2) to an opening position exposing the top on the front side of the first storage part 3 (a state of FIG. 3, FIG. 4).

A head holder 10 is disposed inside the first openable cover 8*a* (see also FIG. 3). The first openable cover 8*a* can rotate around the above described rotation axis K1 to move a printing head 11 included in the head holder 10 relatively away from/close to a feeding roller 12 disposed on the housing main body 2*a*. Specifically, the first openable cover 8*a* can rotate from the closing position at which the printing head 11 is located close to the feeding roller 12 (the state of FIG. 1, FIG. 2) to the opening position at which the printing head 11 is located away from the feeding roller 12 (the state of FIG. 3, FIG. 4).

The second openable cover 8*b* is disposed on the rear side relative to the above described first openable cover 8*a* and can rotate around a predetermined rotation axis K2 disposed on an upper end part on the rear side of the housing main body 2*a* to open and close the top on the rear side of the first storage part 3 separately from opening/closing of the above described first openable cover 8*a*. Specifically, the second openable cover 8*b* can rotate from a closing position covering the top on the rear side of the first storage part 3 (the state of FIGS. 1 and 2) to an opening position exposing the top on the rear side of the first storage part 3 (the state of FIGS. 3 and 4).

When both the first openable cover 8*a* and the second openable cover 8*b* are in the closing state, an outer circumferential part 18 of the first openable cover 8*a* and an edge part 19 of the second openable cover 8*b* are brought into contact with each other to substantially entirely cover the top of the first storage part 3.

The front openable cover 9 is connected to an upper part on the front side of the housing main body 2*a* in an openable manner. The front openable cover 9 can rotate around a predetermined rotation axis K3 disposed on an upper end part on the front side of the housing main body 2*a* to open and close the top of the third storage part 4. Specifically, the front openable cover 9 can rotate from a closing position covering the top of the third storage part 4 (the state of FIG. 1, FIG. 2) to an opening position exposing the top of the third storage part 4 (the state of FIG. 3, FIG. 4).

<Print-Receiving Tape Roll and Periphery Thereof>

As shown in FIGS. 2 to 4, a tape cartridge TK (see FIG. 2) is detachably mounted on the housing main body 2*a* at a first predetermined position 13 located under the front openable cover 9 in the closing state. The tape cartridge TK includes a print-receiving tape roll R1 wound and formed around an axis O1.

In particular, as shown in FIG. 5, the tape cartridge TK includes the print-receiving tape roll R1 and a coupling arm 16. The coupling arm 16 includes a pair of left and right first bracket parts 20, 20 disposed on the rear side, and a pair of left and right second bracket parts 21, 21 disposed on the front side.

The first bracket parts 20, 20 sandwich the above described print-receiving tape roll R1 via a pair of left and right substantially circular roll flange parts f1, f2 from both the left and right sides along the axis O1, and rotatably hold the print-receiving tape roll R1 around the axis O1 while the tape cartridge TK is mounted on the housing main body 2*a* (detailed structure of holding will be described later). These first bracket parts 20, 20 are connected at upper end parts through a first connecting part 22 extended substantially along the left-right direction while avoiding interference with the outer diameter of the print-receiving tape roll R1.

The print-receiving tape roll R1 is freely rotatable when the tape cartridge TK is mounted inside the housing main body 2*a*. In the print-receiving tape roll R1, a print-receiving tape 150 (including a print-receiving layer 154, a base layer 153, an adhesive layer 152, and a separation material layer 151; see an enlarged view of FIG. 2) to be fed out and consumed is wound around the axis O1 of the left-right direction in advance.

When the above described tape cartridge TK is mounted, the print-receiving tape roll R1 is received from above and stored in the first storage part 3 with the axis O1 of winding of the print-receiving tape 150 defined in the left-right direction. While being stored in the first storage part 3 (while the tape cartridge TK is mounted), the print-receiving tape roll R1 rotates in a predetermined rotation direction (direction A in FIG. 2) in the first storage part 3 to feed out the print-receiving tape 150.

In the case described in this embodiment, the print-receiving tape 150 having adhesiveness is used. Therefore, the print-receiving tape 150 has the print-receiving layer 154, the base layer 153, the adhesive layer 152, and the separation material layer 151 laminated in this order in a thickness direction from one side (the top side in FIG. 2) toward the other side (the bottom side in FIG. 2). The print-receiving layer 154 is a layer on which a desired print part 155 (see a partially enlarged view of FIG. 2) is formed through heat transfer printing with ink by the above described printing head 11. The adhesive layer 152 is a layer for affixing the base layer 153 to a suitable adherend (not shown). The separation material layer 151 is a layer covering the adhesive layer 152.

<Feeding Roller and Printing Head>

Returning to FIGS. 2 to 4, the above described feeding roller 12 is disposed on a top middle side of the first storage part 3 and the second storage part 5 in the housing main body 2*a*. The feeding roller 12 is driven via a gear mechanism (not shown) by a feeding motor M1 disposed inside the housing main body 2*a*, and thereby feeds the print-receiving tape 150 fed out from the print-receiving tape roll R1 stored in the first storage part 3, in a tape posture with a tape width direction defined as the left-right direction. In this state, as shown in FIG. 2, a feeding path of the print-receiving tape 150 is bent at the feeding roller 12. In particular, the movement direction of the tape guided forward (leftward in FIG. 2) in a substantially horizontal direction is bent at the feeding roller 12 to a downward oblique direction. In FIG. 2, the print-receiving tape 150 fed along the path of feeding by the above described feeding roller 12 is indicated by a solid line or a dashed-two dotted line as appropriate in accordance with a tape consumed amount (or taken-up amount).

The above described head holder 10 disposed on the first openable cover 8*a* includes the above described printing head 11. The printing head 11 can relatively be moved away from/close to the feeding roller 12 by rotating the first openable cover 8*a* around the rotation axis K1 as described above. In particular, when the first openable cover 8*a* is in the closing state, the printing head 11 is located close to the feeding roller 12, and when the first openable cover 8*a* is in the opening state, the printing head 11 is located away from the feeding roller 12. The printing head 11 is disposed on the head holder 10 at a position facing the top of the feeding roller 12 in the closing state of the first openable cover 8*a*, so as to sandwich and support the print-receiving tape 150 fed by the feeding roller 12 in cooperation with the feeding roller 12. Therefore, if the first openable cover 8*a* is in the closing state, the printing head 11 and the feeding roller 12 are arranged facing each other in the top-bottom direction. On the print-receiving layer 154 of the print-receiving tape 150 sandwiched with the feeding roller 12, the printing head 11 forms a desired print by using an ink ribbon IB of an ink ribbon cartridge RK described later, thereby turning the print-receiving tape 150 into a printed tape 150'.

<Ink Ribbon Cartridge>

As shown in FIGS. 2 and 3, the ink ribbon cartridge RK is detachably mounted on a second predetermined position 14 under the first openable cover 8*a* and above the tape cartridge TK in the closing state of the housing main body 2*a*. FIG. 6 shows a detailed structure of the ink ribbon cartridge RK.

As shown in FIG. 6, the ink ribbon cartridge RK includes a cartridge housing 80, a ribbon feed-out roll R4 that is the unused wound ink ribbon IB capable of being fed out, and a ribbon take-up roll R5. The cartridge housing 80 has a feed-out roll storage part 81 on the rear side, a take-up roll storage part 82 on the front side, and a coupling part 83 coupling the both storage parts 81, 82. The coupling part 83 couples the above described take-up roll storage part 82 and the above described feed-out roll storage part 81 such that the above described ink ribbon IB fed out from the ribbon feed-out roll R4 is exposed outside the cartridge housing 80.

The feed-out roll storage part 81 is formed by combining a substantially half-cylindrical upper part 81*a* (portion on one side) with a lower part 81*b*. The ribbon feed-out roll R4 is freely rotatably supported in the feed-out roll storage part 81 and rotates in a predetermined rotation direction (direction D of FIG. 2) in a mounted state of the ink ribbon cartridge RK so as to feed out the ink ribbon IB for performing print formation by the printing head 11.

The take-up roll storage part 82 is formed by combining a substantially half-cylindrical upper part 82*a* with a lower part 82*b*. The ribbon take-up roll R5 is freely rotatably supported in the take-up roll storage part 82 and rotates in a predetermined rotation direction (direction E of FIG. 2) in a mounted state of the ink ribbon cartridge RK so as to take up the used ink ribbon IB after the print formation.

Therefore, in FIG. 2, the ink ribbon IB fed out from the ribbon feed-out roll R4 is disposed closer to the printing head 11 on the print-receiving tape 150 sandwiched between the printing head 11 and the feeding roller 12 and comes into contact with the bottom of the printing head 11. The ink of the ink ribbon IB is heated by the printing head 11 and transferred to the print-receiving layer 154 of the print-receiving tape 150 for performing the print formation, and the used ink ribbon IB is then taken up by the ribbon take-up roll R5.

<Separation Material Roll and Periphery Thereof>

As shown in FIG. 5, the coupling arm 16 of the tape cartridge TK includes a peeling part 17 including a substantially horizontal slit shape, for example. The peeling part 17 is a position peeling off the separation material layer 151 from the printed tape 150' fed out from the print-receiving tape roll R1 toward the front side. By peeling off the separation material layer 151 by the peeling part 17, as shown in FIG. 2, the printed tape 150' having a print formed as described above is divided into the separation material layer 151 and a printed tape 150" made up of the print-receiving layer 154, the base layer 153, and the adhesive layer 152 other than the separation material layer 151.

As shown in FIGS. 2 and 5, the tape cartridge TK has a separation material roll R3 formed by winding the above described peeled separation material layer 151 around an axis O3. In particular, when the tape cartridge TK described above is mounted, the separation material roll R3 is received from above and stored with the axis O3 for winding of the separation material layer defined in the left-right direction. While being stored in the second storage part 5 (while the tape cartridge TK is mounted), the separation material roll R3 is driven via the gear mechanism (not shown) by a separation sheet take-up motor M3 disposed on an inner substrate 2*b* of the housing main body 2*a* to rotate in a predetermined rotation direction (direction C of FIG. 2) in the second storage part 5, thereby taking up the separation material layer 151.

In this case, as shown in FIG. 5, the above described second bracket parts 21, 21 of the tape cartridge TK sandwich the above described separation material roll R3 via a pair of left and right substantially circular roll flange parts f3, f4 from both the left and right sides along the axis O3, and rotatably hold the separation material roll R3 around the axis O3 while the tape cartridge TK is mounted on the housing main body 2*a* (details of a holding structure will be described later). These second bracket parts 21, 21 are connected at upper end parts through a second connecting part 23 extended substantially along the left-right direction. The first bracket parts 20, 20 and the first connecting part 22 on the rear side are coupled to the second bracket parts 21, 21 and the second connecting part 23 on the front side by a pair of left and right roll-coupling beam parts 24, 24.

It is noted that FIG. 5 shows the state before the separation material roll R3 is formed by winding the separation material layer 151 around the axis O3 (the case of the unused tape cartridge TK). Therefore, FIG. 5 shows the substantially circular above described roll flange parts f3, f4 disposed to sandwich the separation material layer 151 on the both sides in the width direction and includes reference numeral "R3" added for convenience to a position where the separation material roll R3 is formed.

<Printed Tape Roll and Periphery Thereof>

On the other hand, as shown in FIGS. 2 and 4, the above described third storage part 4 receives from above a take-up mechanism 40 for sequentially winding the above described printed tape 150". The take-up mechanism 40 is stored with an axis O2 of winding of the printed tape 150" defined in the left-right direction and is rotatably supported around the axis O2. While being stored in the third storage part 4, the take-up mechanism 40 is driven via the gear mechanism not shown by an adhesive take-up motor M2 disposed inside the housing main body 2*a* to rotate in a predetermined rotation direction (direction B of FIG. 2) in the third storage part 4, thereby taking and piling up the printed tape 150". As a result, the printed tape 150" is sequentially wound around the outer circumferential side of the take-up mechanism 40, thereby forming a printed tape roll R2.

<Cutter Mechanism>

As shown in FIG. 2, a cutter mechanism 30 is disposed downstream of the printing head 11 and upstream of the printed tape roll R2 along the tape feeding direction.

Although not shown in detail, the cutter mechanism 30 has a movable blade, and a running body capable of supporting the movable blade and running in the tape width direction (in other words, left-right direction). The running body is driven by a cutter motor (not shown) to run to move the movable blade in the tape width direction so as to cut the above described printed tape 150" in the tape width direction. The cutter mechanism 30 is located downstream of the printing head 11 and upstream of the take-up mechanism 40 including the above described core 41 along the above described feeding path.

<General Operation of Tape Printer>

A general operation of the tape printer 1 having the above described configuration will be described.

When the tape cartridge TK is mounted on the first predetermined position 13, the print-receiving tape roll R1 is stored in the first storage part 3 located on the rear side of the housing main body 2*a*, and the axis O3 side for forming the separation material roll R3 is stored in the second storage part 5 located on the front side of the housing main body 2*a*. The take-up mechanism 40 for forming the printed tape roll R2 is stored in the third storage part 4 located on the front side of the housing main body 2*a*.

In this state, when the feeding roller 12 is driven, the print-receiving tape 150 is fed out by the rotation of the print-receiving tape roll R1 stored in the first storage part 3 and is fed toward the front side. On the print-receiving layer 154 of the print-receiving tape 150 being fed, the printing head 11 forms a desired print to turn the tape into the printed tape 150'. When the printed tape 150' after print formation is further fed toward the front side to the peeling part 17, the peeling part 17 peels off the separation material layer 151 to turn the tape into the printed adhesive tape 150". The peeled separation material layer 151 is fed toward the bottom side and introduced into the second storage part 5 and is wound around in the second storage part 5 to form the separation material roll R3.

On the other hand, the printed adhesive tape 150" after peel-off of the separation material layer 151 is further fed toward the front side and introduced into the third storage part 4 and is wound around the outer circumferential side of the take-up mechanism 40 in the third storage part 4 to form the printed tape roll R2. In this state, the cutter mechanism 30 disposed downstream in the feeding direction (i.e., on the front side) cuts the printed adhesive tape 150". As a result, a user can cut the printed adhesive tape 150" gradually wound around the printed tape roll R2 at desired timing and take out the printed tape roll R2 from the third storage part 4 after cutting.

Although not described with reference to the drawings, a non-adhesive tape (tape without the above described adhesive layer 152 and separation material layer 151) may be wound around the print-receiving tape roll R1. Also in this case, when the tape cartridge TK is mounted, the print-receiving tape roll R1 formed by winding the non-adhesive tape is received from above and stored in the first storage part 3 with the axis O1 of winding of the non-adhesive tape defined in the left-right direction. While being stored in the first storage part 3 (while the tape cartridge TK is mounted), the print-receiving tape roll R1 rotates in a predetermined rotation direction (direction A in FIG. 2) in the first storage part 3 to feed out the non-adhesive tape.

In this case, a chute 15 (see FIG. 2) may be disposed for switching the feeding path of the non-adhesive tape (or the above described print-receiving tape 150) between a path toward the printed tape roll R2 and a path toward a discharging exit (not shown). In particular, by switching the tape path through a switching operation of the chute 15 with a switching lever (not shown), the non-adhesive tape (or the printed tape 150") after print formation may directly be discharged without winding in the third storage part 4 as described later, to the outside of the housing 2 from a discharging exit (not shown) disposed on the housing 2 on the side of the second openable cover 8*b*, for example.

<Detailed Structures Near Axes of Rolls>

One of the characteristics of this embodiment is in the detailed structures of the print-receiving tape roll R1 and the separation material roll R3 included in the above described tape cartridge TK near the axes O1, O3. Details thereof will hereinafter be described in order.

<Details of Support Structure of Print-Receiving Tape Roll>

As shown in FIG. 5 and FIGS. 7 and 8, the print-receiving tape roll R1 includes a core 103. In particular, the above described print-receiving tape roll R1 is formed by winding the above described print-receiving tape 150 around the outer circumference of the core 103 (=forming a roll-shaped winding body RR) such that the tape can be fed out.

The core 103 is rotatably supported by a fixed shaft member 106 formed by directly coupling a left and right pair of a left fixed shaft part 106L and a right fixed shaft part 106R to each other. Therefore, the core 103 has a double cylinder structure integrally including an external cylinder 103A and an internal cylinder 103B. A short cylindrical part 115*a* located on the right end side of the left fixed shaft part 106L is slidably inserted from the left side of the internal cylinder 103B. A through-hole 20L (schematically shown in FIG. 8) having an inner diameter larger than an outer diameter of the short cylindrical part 115*a* is disposed on the above described first bracket part 20 on the left side. The short cylindrical part 115*a* is inserted into the internal cylinder 103B of the above described core 103 located on the opposite side (i.e., the right side) via the first bracket part 20 while penetrating the through-hole 20L.

Similarly, a long cylindrical part 115*b* located on the left end side of the right fixed shaft part 106R is slidably inserted from the right side of the internal cylinder 103B. A through-hole 20R (schematically shown in FIG. 8) having an inner diameter larger than an outer diameter of the long cylindrical part 115*b* is disposed on the above described first bracket part 20 on the right side. The long cylindrical part 115*b* is inserted into the internal cylinder 103B of the above described core 103 located on the opposite side (i.e., the left side) via the first bracket part 20 while penetrating the through-hole 20R.

Subsequently, locking pieces 111*b* of the right fixed shaft part 106R engage with respective locking holes 111*a* disposed on the left fixed shaft part 106L at multiple circumferential positions, so that the left/right fixed shaft parts 106L, 106R are coupled to and integrated with each other. As a result, the core 103 becomes slidably rotatable around a fixed central shaft that is the fixed shaft member 106 made up of the left/right fixed shaft parts 106L, 106R between the left and right pair of the first bracket parts 20, 20.

In this case, a plurality of locking holes 103*a* is formed along the axial direction in the surface of the external cylinder 103A. On the other hand, circular opening parts fb are disposed on the center side of the roll flange parts f1, f2. Locking projections fa are formed on inner circumferential edges of the circular opening parts fb. By fitting the locking projections fa of the roll flange parts f1, f2 to any of the locking holes 103*a* of the external cylinder 103A, the roll flange parts f1, f2 can be fixed to a position corresponding to the width of the print-receiving tape 150 included in the print-receiving tape roll R1 (see also FIG. 15 described later).

As described above, the left/right fixed shaft parts 106L, 106R included in the above described fixed shaft member 106 have the short cylindrical part 115*a* and the long cylindrical part 115*b* inserted (via a play dimension) into the through-holes 20L, 20R as described above. However, these left/right fixed shaft parts 106L, 106R are non-rotatably engaged to the first bracket parts 20, 20 by respectively included positioning flange parts 105L, 105R. In particular, as shown in FIG. 5 and FIG. 7, each of the first bracket parts 20 has a first guide part 104 having a substantially elliptical (rounded rectangle) shape as a whole including two upper/lower arc parts 104*b*, 104*b* and two front/rear linear parts 104*a*, 104*a*, near a lower end part. On the other hand, the above described positioning flange parts 105L, 105R have a substantially rounded rectangle shape (slightly smaller than the first guide part 104) as a whole including two front-rear outer edge parts 105*a*, 105*a* having a linear shape formed along the up-down direction (in other words, having a planar shape parallel to the gravity direction). When the short cylindrical part 115*a* is inserted into the through-hole 20L as described above, the positioning flange part 105L is stored into the above described first guide part 104 of the left first bracket part 20 such that the above described outer edge parts 105*a*, 105*a* are substantially along the above described linear parts 104*a*, 104*a*. Similarly, when the long cylindrical part 115*b* is inserted into the through-hole 20R, the positioning flange part 105R is stored in the above described first guide part 104 of the right first bracket part 20 such that the above described outer edge parts 105*a*, 105*a* are substantially along the above described linear parts 104*a*, 104*a*. As a result, while the left/right positioning flange parts 105L, 105R are stored in the first guide parts 104, 104, the left/right fixed shaft parts 106L, 106R are non-rotatably engaged with the left-right first bracket parts 20, 20. Such engagement of the positioning flange parts 105L, 105R with the first guide parts 104 results in positioning of a disposition direction of all the constituent elements shown in FIG. 8 (a roll mechanism with a shaft RM made up of the fixed shaft member 106, the print-receiving tape roll R1, and the left/right roll flange parts f1, f2) (details of the positioning will be described later).

The configuration as described above allows the roll flange parts f1, f2 and the core 103 to integrally rotate between the left and right pair of the first bracket parts 20, 20 relative to the fixed shaft member 106 locked to the first bracket parts 20. As a result, the print-receiving tape roll R1 is rotatably supported around the above described axis O1 relative to the first bracket parts 20, 20 and can rotate to feed out the print-receiving tape 150.

<Memory Incorporated at Shaft End of Left Fixed Shaft Part>

One of the characteristics of this embodiment is that a memory 107 is disposed on the left fixed shaft part 106L included in the above described fixed shaft member 106. Details thereof will hereinafter be described in order.

As shown in FIGS. 9A to 9D and above described FIG. 8, FIG. 7, etc., the above described left fixed shaft part 106L includes a shaft-end housing part 121 on the side opposite to the above described short cylindrical part 115*a* (i.e., on the left side) across the positioning flange part 105L. The shaft-end housing part 121 has an outer shape that is a laterally-facing substantially D-shape when viewed in the axial direction. The above described memory 107 is incorporated inside this shaft-end housing part 121.

Additionally, a terminal part 107*a* is disposed on and exposed outside the shaft-end housing part 121 in an opening plane thereof disposed on a bottom linear part of the above described D-shape (in other words, an opening disposed on an action plane on which a reaction to the weight of the print-receiving tape roll R1 acts) (see FIG. 9D and FIG. 7).

The terminal part 107*a* is conductive with the above described memory 107. When the tape cartridge TK is mounted inside the housing main body 2*a* as described later (in other words, when the first guide part 104 of the first bracket part 20 described later is inserted into a first introduction groove 101 described later), the terminal part 107*a* is brought into contact from above and made conductive with an external terminal 207 (only conceptually shown as a position in FIG. 4; see also FIG. 14 described later) disposed on an inner circumferential side position (described later) of a left side surface wall of the housing main body 2*a*. As a result, information can be read from or written to the above described memory 107 arranged to connect to this terminal part 107*a* from the housing 2 side.

Although the memory 107 is disposed on the fixed shaft member 106 rotatably supporting the print-receiving tape roll R1 in the tape cartridge TK including the print-receiving tape roll R1 and the separation material roll R3 in the above example, this is not a limitation. In particular, as shown in FIG. 10 (the same portions as those described above are denoted by the reference numerals), in the roll mechanism with a shaft RM in which the roll flange parts f1, f2 and the print-receiving tape roll R1 formed around the core 103 (not shown) rotate relatively to the fixed shaft member 106, the memory 107 may be disposed on the fixed shaft member 106. In this case, the entire roll mechanism with a shaft RM is attached to a suitable mounting position and, for example, removably fixed (i.e., mounted) by the positioning flange part 105L and the positioning flange part 105R (not shown) on the left/right of the fixed shaft member 106. At the time of the mounting, the above described terminal part 107*a* is brought into contact and made conductive with the external terminal 207 disposed on the mounting position. As a result, information can be read from or written to the above described memory 107 arranged to connect to this terminal part 107*a* from the outside of the roll mechanism with a shaft RM.

<Detailed Structure Near Axis of Separation Material Roll>

Returning to FIG. 5 and FIG. 7, on the other hand, the separation material roll R3 has the support structure similar to the above described print-receiving tape roll R1 although not shown in detail. In particular, the separation material roll R3 includes a core 108, and the above described separation material roll R3 is formed by taking up and winding the separation material layer 151 peeled off as described above around the outer circumference of the core 108 (=forming a roll-shaped winding body).

The core 108 is rotatably supported by a fixed shaft member 110. As is the case with the above described core 103, the core 108 has a double cylinder structure of an external cylinder and an internal cylinder. A through-hole (not shown) having an inner diameter larger than an outer diameter of the above described external cylinder is disposed on each of the above described second bracket parts 21, 21 on the left and right. A shaft body part (a portion corresponding to the above described short cylindrical part 115*a* and long cylindrical part 115*b*; not shown) of the fixed shaft member 110 is slidably inserted into the internal cylinder of the above described core 108 while penetrating the through-hole. As a result, the core 108 becomes slidably rotatable around a fixed central shaft that is the above described fixed shaft member 110 between the left and right pair of the second bracket parts 21, 21.

In this case, a plurality of locking holes is formed along the axial direction in the surface of the external cylinder of the above described core 108 as is the case with the locking holes 103*a* of the above described core 103. On the other hand, locking projections (not shown) similar to the locking projections fa of the above described roll flange parts f1, f2 are formed on the center side of the roll flange parts f3, f4. By fitting the above described locking projections of the roll flange parts f3, f4 to any of the above described locking holes of the external cylinder of the above described core 108, the roll flange parts f3, f4 can be fixed to a position corresponding to the width of the separation material 151 included in the separation material roll R3 (in other words, the width of the print-receiving tape 150).

The configuration as described above allows the roll flange parts f3, f4 and the core 108 to integrally rotate between the left and right pair of the second bracket parts 21, 21 relative to the fixed shaft member 110. As a result, the separation material roll R3 is rotatably supported around the above described axis O3 relative to the second bracket parts 21, 21. The fixed shaft member 110 is operatively coupled via the gear mechanism (not shown) to the separation sheet take-up motor M3 and can be rotated by a drive force from the separation sheet take-up motor M3 to take up the above described separation material layer 151 peeled off from the above described print-receiving tape 150.

<Guide by First and Second Guide Parts During Mounting>

Another characteristic of this embodiment is in a configuration of guiding for mounting the tape cartridge TK in a correct posture when a user mounts the above described tape cartridge TK on the inside of the above described housing main body 2*a*. Details thereof will hereinafter be described in order.

<First Guide Part and First Introduction Groove>

As already described, each of the first bracket parts 20 has the above described first guide part 104 near the lower end part. As shown in FIG. 5 and FIG. 7, the first guide part 104 includes the two upper/lower arc parts 104*b*, 104*b* and the two front/rear substantially vertical linear parts 104*a*, 104*a*, and has a substantially elliptical (rounded rectangle) shape as a whole. Accordingly, as shown in FIG. 4, the substantially U-shaped first introduction groove 101 is included inside the first storage part 3 of the housing main body 2*a*. The first introduction groove 101 includes parallel linear parts 101*b*, 101*b* allowing the above described first guide part 104 to enter while limiting the entry direction (described later in detail). As a result, the storage of the print-receiving tape roll R1 into the first storage part 3 is guided by the first guide part 104 (described later in detail).

<Second Guide Part and Second Introduction Groove>

On the other hand, as shown in FIG. 5 and FIG. 7, each of the second bracket parts 21 has a substantially circular frame-shaped second guide part 109 near a lower end part. Accordingly, as shown in FIG. 4, a substantially V-shaped second introduction groove 102 is included inside the second storage part 5 of the housing main body 2*a*. The second introduction groove 102 allows the above described second guide part 109 to enter. As a result, the storage of the separation material roll R3 into the second storage part 5 is guided by the second guide part 109 (described later in detail).

<Details of Guide Function>

Description will be made of details of a guide function by the above described first guide part 104 and second guide part 109 at the time of mounting of the tape cartridge TK with reference to FIG. 11 and FIG. 12.

As already described, when a user mounts the tape cartridge TK, the above described print-receiving tape roll R1 is stored in the first storage part 3 and the separation material roll R3 is stored in the second storage part 5. In this case, since the print-receiving tape roll R1 side is normally heavier than the separation material roll R3 side (especially when unused, the separation material roll R3 is not formed), the first guide part 104 is first introduced into the first introduction groove 101. In particular, as shown in FIG. 11, the first guide part 104 is first introduced into the first introduction groove 101 with the light separation material roll R3 side slightly tilted upward. In this case, if the long axis direction of the first guide part 104 (i.e., the direction of the above described linear parts 104*a*, 104*a*) is not coincident with the direction of the parallel linear parts 101*b*, 101*b* of the above described substantially U-shaped first introduction groove 101, the first guide part 104 is placed on an entrance part 101*a* of the first introduction groove 101 and put into an entry limiting state, which prevents the first guide part 104 from entering the first introduction groove 101 (a state of FIG. 11).

In this entry limiting state, the tape cartridge TK can take various postures with the first guide part 104 placed on the entrance part 101*a* of the first introduction groove 101. In this case, as shown in FIG. 11, as the posture of the tape cartridge TK changes, the outer shape of the separation material roll R3 generally draws an arc-like locus C around the vicinity of the entrance part 101*a* of the first introduction groove 101.

After the separation material roll R3 drawing the locus C as described above in accordance with the change in posture of the tape cartridge TK goes over the feeding roller 12 and no longer interferes with the feeding roller 12, the above described entry limiting state is switched to an entry permitting state shown in FIG. 12. In particular, in this entry permitting state, the long axis direction of the first guide part 104 (i.e., the direction of the above described linear parts 104*a*, 104*a*) is coincident with the direction of the parallel linear parts 101*b*, 101*b* of the above described substantially U-shaped first introduction groove 101. As a result, the first guide part 104 is allowed to enter the first introduction groove 101. After the above described left/right first guide parts 104, 104 completely enter the left/right first introduction grooves 101, 101, the above described fixed shaft member 106 is inserted in left/right support concave parts 190, 190 (only the right support concave part 190 is shown in FIG. 4) disposed on the housing main body 2*a* at positions further outside on the left/right of the above described left/right first introduction grooves 101, 101, and is subsequently removably fixed (in other words, mounted). As a result, the weight of the print-receiving tape roll R1 applied to the fixed shaft member 106 is mainly supported by the left/right support concave parts 190, 190. It is noted that the external terminal 207 described above is disposed on the above described left support concave part 190.

When the above described first guide part 104 enters the first introduction groove 101, the above described second introduction groove 102 guides and allows the second guide part 109 to enter. In this case, the above described second guide part 109 of the tape cartridge TK has a substantially circular shape and the above described second introduction groove 102 of the second storage part 5 has a substantially V-shape. Therefore, the above described second guide part 109 is allowed to easily enter (regardless of what posture the tape cartridge TK takes).

<Detection of Tape Remaining Amount of Print-Receiving Tape Roll by Encoder>

A further characteristic of this embodiment is detection of a remaining amount of the print-receiving tape 150 in the print-receiving tape roll R1 and will be described with reference to FIG. 13 etc. As shown in FIG. 13, convex parts 100*b* for detecting a remaining amount (in other words, consumed amount) of the print-receiving tape 150 are formed along the circumferential direction at regular intervals on an outer circumferential surface of the above described internal cylinder 103B included in the above described core 103. Concave parts 100*a* are disposed between the convex parts 100*b* to be detected.

As described above, when the core 103 is slidably supported around the fixed shaft member 106 between the left and right pair of the first bracket parts 20, 20, the right end part of the above described external cylinder 103A does not penetrate the above described through-hole 20R of the right first bracket part 20, while the right end part of the internal cylinder 103B (including the above described convex parts 100*b* and concave parts 100*a*) penetrates the through-hole 20R and is exposed on the right outer side of the right first bracket part 20. As a result, the right first bracket part 20 covers the above described convex parts 100*b* and concave parts 100*a* on the outer circumferential side in the radial direction and the above described positioning flange part 105R of the right fixed shaft part 106R covers the above described convex parts 100*b* and concave parts 100*a* on one side in the axial direction (the right side in this direction).

In this case, as shown in FIG. 4 described above, an encoder 100 performing optical detection with a known technique is disposed on a right inner side wall of the first storage part 3 accordingly to the above description. For example, this encoder 100 includes an optical projector and an optical receiver. When the tape cartridge TK is mounted as described above, the position of the above described encoder 100 is located at a position facing the right positioning flange part 105R described above along the above described axis O1 direction. In this case, the convex parts 100*b* and the concave parts 100*a* of the above described core 103 are located on the side (left side) of the positioning flange part 105R opposite to the encoder 100. The positioning flange part 105R is provided with a detection hole 105*c* for detecting the encoder (see FIG. 8). As a result, the light from the above described optical projector can be applied through the detection hole 105*c* to the convex parts 100*b* or the concave parts 100*a* along the above described axis O1 direction.

In accordance with a rotation state of the internal cylinder 103B of the core 103, if the above described convex parts 100*b* are located on a beam of light (e.g., parallel to the above described axis O1) from the above described optical projector, the light is reflected by the convex parts 100*b*, emitted through the detection hole 105*c* again in the opposite direction, and received by the optical receiver. As a result, the optical receiver outputs a predetermined detection signal corresponding to the above described reception. On the other hand, if the above described concave parts 100*a* are located on the beam of light from the above described optical projector, the light is not received by the optical receiver as described above (or an amount of received light is extremely small). As a result, the optical receiver outputs no detection signal corresponding to the above described reception. From the above, the above described concave parts 100*a* and convex parts 100*b* alternately come onto the above described light beam due to the rotation of the core 103 (in other words, the rotation of the print-receiving tape roll R1) and, consequently, the detection signal from the optical receiver is repeatedly turned on and off in accordance with a cycle corresponding to the above described rotation speed. As a result, based on a length of the cycle, the rotation speed of the above described print-receiving tape roll R1 can be detected.

When the tape cartridge TK is used, the diameter of the print-receiving tape roll R1 is made smaller as the print-receiving tape roll R1 is fed out and consumed from the print-receiving tape 150, resulting in an increase in a roll rotation speed, in other words, a rotation sped of the internal cylinder 103B of the core 103, even at the same tape feed-out speed. As a result, (although not described in detail because of being a known technique) the rotation speed of the core 103, i.e., the print-receiving tape roll R1, can be calculated based on the detection result of the encoder 100 as described above, so as to calculate a degree of reduction in the diameter as described above, i.e., a tape remaining amount, of the print-receiving tape roll R1.

As a result, the concave parts 100*a* and the convex parts 100*b* are disposed on the right side of the core 103 opposite to the left fixed shaft part 106L of the fixed shaft member 106 on which the above described memory 107 is disposed.

<Control System>

A control system of the tape printer 1 will be described with reference to FIG. 14. In FIG. 14, the tape printer 1 includes a CPU 212 making up a calculation portion executing a predetermined calculation. The CPU 212 is connected to a RAM 213 and a ROM 214. The CPU 212 executes a signal process in accordance with a program stored in the ROM 214 in advance while using a temporary storage function of the RAM 213, thereby generally controlling the tape printer 1.

The CPU 212 is also connected to a motor drive circuit 218 carrying out drive control of the above described feeding motor M1 driving the above described feeding roller 12, a motor drive circuit 219 carrying out drive control of the above described adhesive take-up motor M2 driving the above described printed tape roll R2, a motor drive circuit 220 carrying outdrive control of the above described separation sheet take-up motor M3 driving the above described separation material roll R3, a printing head control circuit 221 carrying out energization control of a heat generation element of the above described printing head 11, a display part 215 performing suitable display, and an operation part 216 allowing a user to perform operation and input as needed.

In this embodiment, the CPU 212 is connected to the above described encoder 100. As a result, as described above, the detection signal from the optical receiver of the encoder 100 is input to the CPU 212 and the CPU 212 detects the rotation speed of the above described core 103 based on the cycle of turning on/off of the detection signal (corresponding to the rotation speed of the core 103).

Additionally, in this embodiment, the CPU 212 is connected to the above described external terminal 207. As a result, as described above, when the external terminal 207 is brought into and made conductive with the terminal part 107*a*, information can be read from or written to the above described memory 107.

The ROM 214 stores a control program for executing a predetermined control process. The RAM 213 includes an image buffer 213*a* in which, for example, print data of an image data format received from a PC not shown is developed and stored as dot pattern data for printing in a desired print area of the print-receiving layer 154. Based on a suitable control program stored in the ROM 214, the CPU 212 performs printing corresponding to the print data with the printing head 11 via the printing head control circuit 221 in accordance with the print data stored in the image buffer 213*a* while feeding the print-receiving tape 150 with the feeding roller 12.

<Effect of this Embodiment>

As described above, in this embodiment, the core 103 having the print-receiving tape roll R1 wound therearound is rotatably supported by the fixed shaft member 106. As a result, as described above, when the tape cartridge TK is mounted, the weight of the print-receiving tape roll R1 acting as a rotating body is mainly applied to the above described fixed shaft member 106 (the left fixed shaft part 106L and the right fixed shaft part 106R). The memory 107 described above is disposed on the left fixed shaft part 106L along with the terminal part 107*a*. As a result, as compared to when the memory 107 and the terminal part 107*a* are disposed on other positions to which the weight is less applied, the above described external terminal 207 and the terminal part 107*a* can stably and reliably be brought into contact with each other. As a result, the above described reading or writing of information from or to the memory 107 described above can be performed with high reliability.

Particularly in this embodiment, the terminal part 107*a* is arranged to be exposed outside the shaft-end housing part 121 through the opening thereof disposed on the action plane on which a reaction to the weight of the print-receiving tape roll R1 acts. As a result, the weight can be allowed to reliably act on the terminal part 107*a*, and the external terminal 207 and the terminal part 107*a* can more reliably be brought into contact with each other.

Particularly in this embodiment, the respective positioning flange parts 105L, 105R include the outer edge parts 105*a*, 105*a* that are planes parallel to the above described gravity direction. As a result, when the above described left fixed shaft part 106L is fixed to the above described support concave part 190, the positioning of the disposition direction of the entire roll mechanism with a shaft RM (see FIG. 8) including the print-receiving tape roll R1 can be achieved such that the weight reliably acts along the direction of contact between the terminal part 107*a* and the external terminal 207.

In this embodiment, the first guide part 104 of each of the first bracket parts 20 has a substantially elliptical (rounded rectangle) shape including the two front/rear substantially vertical linear parts 104*a*, 104*a*. The housing main body 2*a* is disposed with the substantially U-shaped first introduction groove 101 including the parallel linear parts 101*b*, 101*b*. When a user mounts the above described tape cartridge TK on the inside of the above described housing main body 2*a*, the first guide part 104 is not allowed to enter the first introduction groove 101 while the direction of the above described linear parts 104*a*, 104*a* of the first guide part 104 is not coincident with the direction of the parallel linear parts 101*b*, 101*b* of the above described substantially U-shaped first introduction groove 101. When the posture of the tape cartridge TK changes and the direction of the above described linear parts 104*a*, 104*a* becomes coincident with the direction of the above described parallel linear parts 101*b*, 101*b*, the first guide part 104 is allowed to enter the first introduction groove 101. As a result, only when the tape cartridge TK takes a predetermined posture, the print-receiving tape roll R1 can be stored into the first storage part 3 and the separation material roll R3 can be stored into the second storage part 5. As a result, since the tape cartridge TK can be prevented from being mounted in an improper posture on the tape printer 1 by a user, a reduction in durability due to collision or interference during mounting can be prevented on the tape cartridge TK or tape printer 1 side.

In this embodiment, to detect a remaining amount (in other words, consumed amount) of the print-receiving tape 150, the above described convex parts 100*b* and concave parts 100*a* acting as the identifier to be detected used as an object of the above described optical detection are formed on the core 103 of the print-receiving tape roll R1 rather than a roll body (roll-shaped winding body RR) or the roll flange parts f1, f2, for example. This has the following meaning.

In particular, the need of using several types of the above described print-receiving tapes 150 having wide and narrow width dimensions may arise. This embodiment has a configuration capable of dealing with such a need. For example, when the wide print-receiving tape 150 is used, as shown in FIG. 15A, the above described locking projections fa of the roll flange parts f1, f2 may be fitted to the respective positions of the locking holes 103*a* corresponding to the maximum width of the external cylinder 103A, and the print-receiving tape 150 may be wound around between the roll flange parts f1, f2 to construct the print-receiving tape roll R1.

Conversely, when the narrow print-receiving tape 150 is used, as shown in FIG. 15B, the above described locking projections fa of the roll flange parts f1, f2 may be fitted to the respective positions of the locking holes 103*a* corresponding to the minimum width of the external cylinder 103A, and the print-receiving tape 150 may be wound around between the roll flange parts f1, f2 to construct the print-receiving tape roll R1. The above described need can be dealt with by appropriately selecting the positions of attachment of the roll flange parts f1, f2 to the core 103 in accordance with the width of the print-receiving tape roll R1 in this way.

Assuming that a structure has the identifier to be detected disposed on a roll body, a flange, etc., as described above, when the above described optical detection is performed by the encoder 100 from one axial side of the print-receiving tape roll R1 (from the right in the example described above), the distance from the encoder 100 to the identifier to be detected varies depending on whether the tape width of the above described print-receiving tape 150 is wide or narrow. As a result, detection accuracy may not be constant, making it difficult to ensure high detection accuracy.

In contrast, in this embodiment, the above described convex parts 100*b* and concave parts 100*a* acting as the identifier to be detected are disposed on the internal cylinder 103B of the core 103 as described above. As a result, even when several types of tapes having wide and narrow widths are used on the print-receiving tape roll R1, (if the core 103 is standardized for all the rolls) a distance x can be made constant from the encoder 100 to the above described convex parts 100*b* and concave parts 100*a* of the above described core 103 (see FIG. 15A and FIG. 15B). As a result, unlike the above described case, the detection accuracy can be made constant and, therefore, the remaining amount of the print-receiving tape 150 can stably and highly accurately be detected.

In this regard, in this embodiment, as described above, the right first bracket part 20 covers the above described convex parts 100*b* and concave parts 100*a* on the outer circumferential side in the radial direction, and the positioning flange part 105R of the right fixed shaft part 106R covers the above described convex parts 100*b* and concave parts 100*a* on the right side. As a result, the above described convex parts 100*b* and concave parts 100*a* can be protected from dust and dirt while avoiding interference with the above described optical detection through the detection hole 105*c* of the positioning flange part 105R as described above. Therefore, this also enables an increase in accuracy of the above described remaining amount detection.

Particularly in this embodiment, the above described memory 107 is disposed on the fixed shaft member 106. As a result, if the tape cartridge TK is repeatedly attached and detached while being used on the above described tape printer 1, the tape cartridge TK itself can always retain the tape remaining amount information of the print-receiving tape roll R1 by the memory 107. As a result, the CPU 212 can read the tape remaining amount information retained by the memory 107 as described above, thereby reliably acquiring the correct tape remaining amount of the print-receiving tape 150. The above described memory 107 is disposed on the left fixed shaft part 106L on the side of the fixed shaft member 106 opposite to the side of detection using the above described convex parts 100*b* and concave parts 100*a* (the right side in this example). As a result, since the encoder 100 detecting the above described convex parts 100*b* and concave parts 100*a* and the above described external terminal 207 reading/writing information from/to the above described memory 107 can be allocated to the above described two sides without concentration to one side in the tape printer 1, a degree of freedom of layout can be ensured.

Although the present disclosure is applied to the tape printer 1 performing a print on the print-receiving tape 150 in the example described above, this is not a limitation and the present disclosure is applicable to a tape processing device executing a process other than the print to a tape. The same effect is provided also in this case.

The arrows shown in FIG. 14 indicate an example of signal flow and are not intended to limit the signal flow directions.

The techniques of the embodiment and the modification examples may appropriately be utilized in combination other than those described above.

What is claimed is:

1. A tape cartridge comprising:

a first tape roll having a first core that includes an outer circumferential side around which a tape is wound, the tape capable of being fed out;

a first support member that is configured to rotatably support said first core of said first tape roll;

a storage medium that is disposed on said first support member and is capable of reading or writing of information;

a terminal part that is disposed on said first support member while being exposed outside and is conductive with said storage medium;

a second tape roll configured to take up and wind, around an outer circumferential side of a second core, at least a portion of said tape fed out from said first tape roll and transported;

a coupling arm disposed so as to couple said first tape roll and said second tape roll;

said first support member that is fixed to a rear end of said coupling arm and rotatably supports said first core of said first tape roll; and a second support member that is fixed to a front end of said coupling arm and rotatably supports said second core of said second tape roll.

2. The tape cartridge according to claim 1, wherein said first support member is configured to be capable of being mounted on a predetermined mounting position.

3. The tape cartridge according to claim 1, wherein:

said storage medium is disposed on a shaft end part of said first support member, and said terminal part is disposed on said shaft end part of said first support member while being exposed to the outside of the tape cartridge.

4. The tape cartridge according to claim 2, wherein said terminal part is disposed so as to be exposed to the outside through an opening of said first support member.

5. The tape cartridge according to claim 4, wherein said opening is disposed on an action plane on which a reaction to a weight of said first tape roll acts when the first support member is mounted on said mounting position.

6. The tape cartridge according to claim 4, wherein:

said first support member has a positioning flange, and said positioning flange has a plane parallel to a direction of gravity.

7. The tape cartridge according to claim 4, wherein:

said first support member has:

a right positioning flange;

a left positioning flange; and a pillar that stands from said left positioning flange;

said right positioning flange is a substantially rounded rectangle right plate including two linear outer edge parts, said left positioning flange is a substantially rounded rectangle left plate including two linear outer edge parts, said pillar stands from said substantially rounded rectangle left plate and includes a curved surface, a plane, and a top surface having a substantially D-shape, and said opening is disposed on the plane corresponding to a linear portion of said substantially D-shape to expose said terminal part from the opening.

8. The tape cartridge according to claim 1, wherein:

said coupling arm includes:

a rear-right bracket and a rear-left bracket disposed to said rear end of the coupling arm; and a front-right bracket and a front-left bracket disposed to said front end of the coupling arm, said first support member is supported by said rear-right bracket and said rear-left bracket, and said second support member is supported by said front-right bracket and said front-left bracket.

9. The tape cartridge according to claim 1, wherein:

said first core includes a predetermined identifier to be detected on a right end in an axial direction, and said first support member includes said storage medium on a left end opposite to said right end in the axial direction.

10. The tape cartridge according to claim 1, wherein:

said first core has a double cylinder structure having an external cylinder with said tape wound around an outer circumferential side thereof and an internal cylinder integrally disposed inside said external cylinder in a radial direction, and said first support member is slidably inserted inside said internal cylinder.

11. A tape cartridge comprising:

a first tape roll having a first core that includes an outer circumferential side around which a tape is wound, the tape capable of being fed out;

a first support member that is configured to rotatably support said first core of said first tape roll;

a storage medium that is disposed on said first support member and is capable of reading or writing of information;

a terminal part that is disposed on said first support member while being exposed outside and is conductive with said storage medium, said terminal part being disposed so as to be exposed to the outside through an opening of said first support member, wherein:

said first support member has:

a right positioning flange;

a left positioning flange; and a pillar that stands from said left positioning flange, said right positioning flange is a substantially rounded rectangle right plate including two linear outer edge parts, said left positioning flange is a substantially rounded rectangle left plate including two linear outer edge parts, said pillar stands from said substantially rounded rectangle left plate and includes a curved surface, a plane, and a top surface having a substantially D-shape, said opening is disposed on the plane corresponding to a linear portion of said substantially D-shape to expose said terminal part from the opening, and said plane is perpendicular to said two outer edge parts.

12. The tape cartridge according to claim 11, further comprising:

a second tape roll configured to take up and wind, around an outer circumferential side of a second core, at least a portion of said tape being fed out from said first tape roll and transported, and a coupling arm disposed to couple said first tape roll and said second tape roll, wherein:

said coupling arm includes:

a rear-right bracket and a rear-left bracket disposed to a rear end of the coupling arm;

a front-right bracket and a front-left bracket disposed to a front end of the coupling arm;

said first support member that is fixed to said rear-right bracket and said rear-left bracket and rotatably supports said first core of said first tape roll; and a second support member that is fixed to said front-right bracket and said front-left bracket and rotatably supports said second core of said second tape roll, said rear-right bracket includes a right guide part that is an annular rib having a rounded rectangle shape, said rear-left bracket includes a left guide part that is an annular rib having a rounded rectangle shape, said right guide part includes two linear parts, said right positioning flange is stored in the said right guide part with said two outer edge parts being along said two linear parts, said left guide part includes two linear parts, and said left positioning flange is stored in the said left guide part with said two outer edge parts being along said two linear parts.

* * * * *